US006875564B2

(12) United States Patent
Kikuchi et al.

(10) Patent No.: US 6,875,564 B2
(45) Date of Patent: Apr. 5, 2005

(54) SILVER HALIDE PHOTOGRAPHIC EMULSION AND SILVER HALIDE PHOTOGRAPHIC LIGHTSENSITIVE MATERIAL USING THE SAME

(75) Inventors: Makoto Kikuchi, Minami-Ashigara (JP); Mikio Ihama, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 240 days.

(21) Appl. No.: 10/241,604

(22) Filed: Sep. 12, 2002

(65) Prior Publication Data

US 2003/0190561 A1 Oct. 9, 2003

(30) Foreign Application Priority Data

Sep. 13, 2001 (JP) ..... 2001-278592

(51) Int. Cl.[7] ..... G03C 1/005; G03C 1/494

(52) U.S. Cl. ..... 430/567; 430/569; 430/502; 430/503

(58) Field of Search ..... 430/567, 569, 430/502, 503

(56) References Cited

U.S. PATENT DOCUMENTS

| | | | | |
|---|---|---|---|---|
| 5,587,280 A | * | 12/1996 | Ikeda et al. | 430/567 |
| 6,100,019 A | | 8/2000 | Brust et al. | |
| 6,280,920 B1 | * | 8/2001 | Maruyama et al. | 430/567 |
| 6,544,725 B2 | * | 4/2003 | Morimoto | 430/567 |

* cited by examiner

*Primary Examiner*—Geraldine Letscher
(74) *Attorney, Agent, or Firm*—Sughrue Mion, PLLC

(57) ABSTRACT

A silver halide photographic emulsion comprising grains, wherein 50% or more (numerical ratio) of all the grains are occupied by tabular grains with epitaxial junction meeting the requirements (i) to (v): (i) silver iodochlorobromide grains having (111) faces as main planes and having two parallel twin planes, (ii) an equivalent circle diameter of 3.0 μm or more and an aspect ratio of 8 or more, (iii) each of host tabular grains has six silver halide epitaxial junction portions selectively in apex portions thereof, (iv) at least one of the silver halide epitaxial junction portions has at least one dislocation line, and (v) a spacing between the two parallel twin planes of 0.012 μm or less.

16 Claims, No Drawings

SILVER HALIDE PHOTOGRAPHIC EMULSION AND SILVER HALIDE PHOTOGRAPHIC LIGHTSENSITIVE MATERIAL USING THE SAME

CROSS-REFERENCE TO RELATED APPLICATIONS

This application is based upon and claims the benefit of priority from the prior Japanese Patent Application No. 2001-278592, filed Sep. 13, 2001, the entire content of which is incorporated herein by reference.

BACKGROUND OF THE INVENTION

1. Field of the Invention

The present invention relates to a silver halide photographic emulsion of high speed and enhanced gradation, and further relates to a silver halide photographic lightsensitive material including the same.

2. Description of the Related Art

In recent years, in rivalry with the spread of digital cameras, the requirements for a silver halide emulsion for photography are becoming stricter, and there is a demand for further enhancement of photographic speed. In particular, even with respect to cheap cameras whose strobe light quantity is likely to be insufficient, such as lens-equipped films being spread, there is a strong demand for a practicable color photographic lightsensitive material of high speed and high image quality. The use of tabular grains is known as providing a technology for attaining a speed increase and an image quality enhancement for the silver halide emulsion. Advantages thereof, such as a speed increase, including an enhancement of color sensitization efficiency, by the use of a sensitizing dye; an improvement of speed/graininess ratio relationship; a sharpness increase attributed to specific optical characteristics of tabular grains; and an increase of covering power, are known in the art to which the present invention pertains. Generally, when the volumes are identical, an increase in the aspect ratio of tabular grains is advantageous from the viewpoint of an enhancement of speed graininess ratio.

The method of sensitizing with the use of epitaxial junction is known as providing means for sensitizing tabular grains. The technologies therefor are disclosed in, for example, Jpn. Pat. Appln. KOKAI Publication No. (hereinafter referred to as JP-A-) 58-108526 and JP-A-59-133540. Further, the applications thereof to tabular grains exhibiting high aspect ratios are disclosed in JP-A's 8-69069, 8-101472, 8-101474, 8-101475, 8-171162, 8-171163, 8-101473, 8-101476, 9-211762 and 9-211763, and U.S. Pat. Nos. 5,612,176, 5,614,359, 5,629,144, 5,631,126, 5,612,176, 5,614,359, 5,629,144, 5,631,126, 5,691,127 and 5,726,007. In particular, in Example part of JP-A-2000-321696, there is disclosed a process for preparing tabular grains of large size and high aspect ratio, which tabular grains have an epitaxial junction in apex portions of grains and have a dislocation line in epitaxial junction portions. Further, technologies for furnishing tabular grains having an epitaxial junction with a hole trapping zone are disclosed in JP-A's 10-268456 and 10-301219.

However, in these patent application specifications, there is no description of the characteristic of the present invention, that is, there is no description suggesting that a photographic emulsion of high photographic speed and enhanced gradation can be provided by tabular grains of large size and high aspect ratio having two parallel twin planes whose spacing is small, which grains have an epitaxial junction in apex portions of grains and have a dislocation line in epitaxial junction portions, and preferably have a hole trapping zone.

BRIEF SUMMARY OF THE INVENTION

The inventor, in pursuit of high photographic speed, has tackled the method of sensitizing tabular grains with the use of epitaxial junction with respect to a silver halide photographic emulsion containing tabular grains of large equivalent circle diameter and high aspect ratio. As a result, it has been revealed that the above prior art technologies are unsatisfactory in respect of speed increase and pose a problem of gradation softening which accompanies an increase of grain size.

It is an object of the present invention to provide an excellent silver halide photographic emulsion of high speed and enhanced gradation and to provide a silver halide photographic lightsensitive material including the same.

The inventor has tackled the method of sensitizing tabular grains with the use of epitaxial junction with respect to a silver halide emulsion containing tabular grains of large equivalent circle diameter and high aspect ratio. As a result, it has first been found that not only unexpectedly high photographic speed but also solving of the problem of gradation softening which accompanies an increase of grain size can be attained by introducing an epitaxial junction in apex portions of grains and further introducing a dislocation line inside epitaxial junction portions and by simultaneously reducing the spacing between two parallel twin planes of tabular grains. Moreover, it has been found that a silver halide emulsion exhibiting much superior photographic performance including higher speed and hard gradation can be obtained by providing a hole trapping zone inside the aforementioned tabular grains.

Therefore, the following silver halide photographic emulsions and silver halide photographic lightsensitive material containing the same are provided by the present invention.

(1) 1. A silver halide photographic emulsion comprising grains, wherein 50% or more (numerical ratio) of all the grains are occupied by tabular grains with epitaxial junction meeting the requirements (i) to (v):

(i) silver iodochlorobromide grains having (111) faces as main planes and having two parallel twin planes;

(ii) an equivalent circle diameter of 3.0 $\mu$m or more and an aspect ratio of 8 or more;

(iii) each of host tabular grains has six silver halide epitaxial junction portions selectively in apex portions thereof;

(iv) at least one of the silver halide epitaxial junction portions has at least one dislocation line; and (v) a spacing between the two parallel twin planes of 0.012 $\mu$m or less.

(2) The silver halide photographic emulsion according to (1) above, wherein the tabular grains with epitaxial junction further meet the following requirement:

(vi) the spacing between the two parallel twin planes of 0.008 $\mu$m or less.

(3) The silver halide photographic emulsion according to (1) above, wherein 70% or more (numerical ratio) of all the grains are occupied by the tabular grains with epitaxial junction meeting the requirements (i) to (v) above.

(4) The silver halide photographic emulsion according to (3) above, wherein the tabular grains with epitaxial junction further meet the following requirement:

(vi) the spacing between the two parallel twin planes of 0.008 μm or less.

(5) The silver halide photographic emulsion according to any one of (1) to (4) above, wherein the tabular grains with epitaxial junction have a hole trapping zone inside the tabular grains.

(6) A silver halide photographic lightsensitive material comprising at least one layer containing a silver halide emulsion on a support, wherein at least one layer among the at least one layer contains the silver halide photographic emulsion according to any one of (1) to (5) above.

DETAILED DESCRIPTION OF THE INVENTION

According to one preferred embodiment of the present invention, there is provided a photographic lightsensitive material comprising at least one layer of the following silver halide photographic emulsion on a support. Specifically, the silver halide photographic emulsion comprises grains, wherein 50% or more (numerical ratio) of all the grains are occupied by tabular grains with epitaxial junction (hereinafter also referred to simply as "tabular grains") characterized by being composed of silver iodochlorobromide grains having (111) faces as main planes and having two parallel twin planes; having an equivalent circle diameter of 3.0 μm or more and an aspect ratio of 8 or more; having six silver halide epitaxial junction portions, per grain, selectively in apex portions of each host tabular grains; having at least one dislocation line in at least one of the silver halide epitaxial junction portions; having a spacing of 0.012 μm or less between the two parallel twin planes; and having a hole trapping zone inside the tabular grains.

First, the shape of the silver halide emulsion of the present invention will be described below.

Tabular grains contained in the emulsion of the present invention is silver halide grains having two opposite parallel (111) main planes. The tabular grains for use in the present invention each have one twin plane or two or more parallel twin planes. The twin plane refers to a (111) face on both sides of which the ions of all lattice points are in the relationship of reflected images. The tabular grains, as viewed in a direction perpendicular to main planes thereof, have triangular or hexagonal shapes, or circular shapes corresponding to rounding thereof. Each thereof has external surfaces arranged parallel to each other.

In the emulsion of the present invention, it is preferred that hexagonal tabular grains whose neighboring side ratio (maximum side length/minimum side length) is in the range of 1.5 to 1 occupy 100 to 50%, in terms of numerical ratio, of all the grains of the emulsion. The above hexagonal tabular grains more preferably occupy 100 to 70%, most preferably 100 to 80%, in terms of numerical ratio, of all the grains of the emulsion. In the emulsion of the present invention, it is especially preferred that hexagonal tabular grains whose neighboring side ratio (maximum side length/minimum side length) is in the range of 1.2 to 1 occupy 100 to 50%, in terms of numerical ratio, of all the grains of the emulsion. The above hexagonal tabular grains more preferably occupy 100 to 70%, in terms of numerical ratio, most preferably 100 to 80%, of all the grains of the emulsion. When the main planes of tabular grains have a rounded triangular or hexagonal shape, the side lengths of main planes refer to those of a virtual triangle or hexagon formed by extending the sides of each of the main planes. The mixing of tabular grains other than the above hexagonal tabular grains into the emulsion is not favorable from the viewpoint of intergranular homogeneity.

In the emulsion of the present invention, tabular grains having an equivalent circle diameter of 3.0 μm or more and an aspect ratio of 8 or more occupy 50% or more (numerical ratio) based on the total number of grains. More preferably, tabular grains having an equivalent circle diameter of 3.0 μm or more and an aspect ratio of 8 or more occupy 70% or more (numerical ratio) based on the total number of grains. The greater the proportion of tabular grains of large equivalent circle diameter and high aspect ratio, favorably the more striking the exerted effects of the present invention.

With respect to the tabular grains contained in the emulsion of the present invention, the average equivalent circle diameter is preferably in the range of 3.0 to 6.0 μm, more preferably 3.0 to 5.0 μm. When the average equivalent circle diameter of tabular grains falls outside these ranges, it is unfavorably difficult to obtain the effects of the present invention. In the present invention, the equivalent circle diameter refers to the diameter of a circle having an area equal to the projected area of parallel external surfaces of grains. The average equivalent circle diameter refers to an arithmetical mean of the equivalent circle diameter values of all the tabular grains contained in the emulsion.

The average aspect ratio of the tabular grains contained in the emulsion of the present invention is preferably in the range of 8 to 100, more preferably 10 to 60, and most preferably 12 to 50. It is difficult to prepare tabular grains whose average aspect ratio exceeds 100. On the other hand, with the use of tabular grains of less than 8 average aspect ratio, it is unfavorably difficult to realize the effects of the present invention. The average aspect ratio is an arithmetical mean of the aspect ratio values of all the tabular grains contained in the emulsion.

The ratio of equivalent circle diameter to thickness with respect to silver halide grains is referred to as "aspect ratio". That is, the aspect ratio is the quotient of the equivalent circle diameter of the projected area of each individual silver halide grain divided by the grain thickness.

The equivalent circle diameter of tabular grains is determined by, for example, taking a transmission electron micrograph according to the replica method and obtaining the diameter of a circle having an area equal to the projected area of each individual grain. The thickness of tabular grains cannot be simply calculated from the length of the shadow of the replica because of the epitaxial deposition. However, the calculation can be made by measuring the length of the shadow of the replica before the epitaxial deposition. Alternatively, even after the epitaxial deposition, the thickness of tabular grains can be easily determined by slicing a tabular grain coating sample to thereby obtain a section and taking an electron micrograph of the section.

In the emulsion of the present invention, tabular grains having a spacing between two parallel twin planes of 0.012 μm or less occupy preferably 50% or more (numerical ratio), more preferably 70% or more, based on the total number of grains. More preferably, tabular grains having a spacing between two parallel twin planes of 0.008 μm or less occupy 50% or more (numerical ratio), most preferably 70% or more, based on the total number of grains. The greater the proportion of tabular grains of small spacing between two parallel twin planes, favorably the more striking the exerted effects of the present invention.

The twin plane can be observed through a transmission electron microscope. Specifically, a sample in which tabular grains are arranged approximately in parallel to a support is prepared. The sample is cut with a diamond knife to thereby prepare an about 0.1 μm thick section. The twin plane of tabular grains can be detected by observing the section through a transmission electron microscope. When electron beams pass through the twin plane, a phase shift occurs in the electron waves. Thus, the presence of twin plane can be recognized.

In the present invention, for forming tabular grains having two parallel twin planes whose spacing is small, various techniques may be selected according to circumstances. For example, it is preferred to carry out nucleation under low temperature and high potential conditions, such as 20 to 40° C. and pAg=about 9, or to carry out nucleation with the use of oxidized gelatin having low molecular weight.

It is preferred that the emulsion of the present invention be composed of monodisperse grains. The variation coefficient of grain size (equivalent sphere diameter) distribution with respect to all the grains contained in the emulsion of the present invention is preferably in the range of 35 to 3%, more preferably 25 to 3%, and most preferably 20 to 3%. The terminology "variation coefficient of equivalent sphere diameter distribution" used herein means the product obtained by dividing the dispersion (standard deviation) of equivalent sphere diameters of individual tabular grains by the average equivalent sphere diameter and multiplying the resultant quotient by 100. That the variation coefficient of equivalent sphere diameter distribution with respect to all the tabular grains exceeds 35% is not favorable from the viewpoint of intergranular homogeneity. On the other hand, it is difficult to prepare an emulsion wherein the above variation coefficient is below 3%.

The variation coefficient of equivalent circle diameter distribution with respect to all the grains contained in the emulsion of the present invention is preferably in the range of 40 to 3%, more preferably 30 to 3%, and most preferably 20 to 3%. The terminology "variation coefficient of equivalent circle diameter distribution" used herein means the product obtained by dividing the dispersion (standard deviation) of equivalent circle diameters of individual grains by the average equivalent circle diameter and multiplying the resultant quotient by 100. That the variation coefficient of equivalent circle diameter distribution of all the grains exceeds 40% is not favorable from the viewpoint of intergranular homogeneity. On the other hand, it is difficult to prepare an emulsion wherein the above variation coefficient is below 3%.

The variation coefficient of grain thickness distribution with respect to all the tabular grains contained in the emulsion of the present invention is preferably in the range of 25 to 3%, more preferably 20 to 3%, and most preferably 15 to 3%. The terminology "variation coefficient of grain thickness distribution" used herein means the product obtained by dividing the dispersion (standard deviation) of thicknesses of individual tabular grains by the average grain thickness and multiplying the resultant quotient by 100. That the variation coefficient of grain thickness distribution with respect to all the tabular grains exceeds 25% is not favorable from the viewpoint of intergranular homogeneity. On the other hand, it is difficult to prepare an emulsion wherein the above variation coefficient is below 3%.

The variation coefficient of twin plane spacing distribution with respect to all the tabular grains contained in the emulsion of the present invention is preferably in the range of 25 to 3%, more preferably 20 to 3%, and most preferably 15 to 3%. The terminology "variation coefficient of twin plane spacing distribution" used herein means the product obtained by dividing the dispersion (standard deviation) of twin plane spacings of individual tabular grains by the average twin plane spacing and multiplying the resultant quotient by 100. That the variation coefficient of twin plane spacing distribution with respect to all the tabular grains exceeds 25% is not favorable from the viewpoint of intergranular homogeneity. On the other hand, it is difficult to prepare an emulsion wherein the above variation coefficient is below 3%.

Now, the composition and structure of the tabular grains for use in the present invention will be described.

With respect to the silver halide composition of the tabular grains for use in the present invention, the tabular grains are constituted of silver iodochlorobromide. Fundamentally, the host tabular grains are constituted of silver iodobromide or silver iodochlorobromide, and the epitaxial junction portions are constituted of silver chloride, silver chlorobromide and silver iodochlorobromide, and thus the tabular grains are constituted of any of combinations thereof. The silver chloride content of the tabular grains (ratio to the total silver quantity of host tabular grains together with epitaxial junction portions) is preferably in the range of 1 to 6 mol %. More preferably, the silver chloride content is in the range of 2 to 5 mol %. The silver iodide content of the tabular grains (ratio to the total silver quantity of host tabular grains together with epitaxial junction portions) is preferably 2 mol % or more. More preferably, the silver iodide content is in the range of 2 to 10 mol %.

In the host tabular grains of the present invention, it is preferred that the proportion of outermost layers having a silver iodide content of 18 mol % or more be 20% or less in terms of silver. Herein, the silver iodide content of outermost layers refers to mol % based on the amount of silver contained in the outermost layers. Although the structure of parts lying inside the outermost layers is not limited, the silver iodide content thereof is fundamentally lower than that of the outermost layers. The proportion of outermost layers is preferably in the range of 5 to 20%, more preferably 10 to 15%, in terms of silver. The silver iodide content of outermost layers is preferably in the range of 3 to 30 mol %. When these conditions are not satisfied, the epitaxial deposition would become nonuniform intergranularly, and incorporation of dislocation lines would not be effected, so that it would be difficult to attain the effects of the present invention.

Preferably in the present invention, with respect to 70% or more of the total projected area, the silver chloride content is in the range of 0.7 to 1.3 CL, more preferably 0.8 to 1.2 CL, provided that CL (mol %) represents the average silver chloride content of all the silver halide grains. The epitaxial deposition is uniform intergranularly in the emulsion of the present invention, so that, fundamentally, the intergranular distribution of silver chloride content is monodisperse. Furthermore, with respect to 70% or more of the total projected area, the silver iodide content is preferably in the range of 0.7 to 1.3 I, more preferably 0.8 to 1.2 I, provided that I (mol %) represents the average silver iodide content of all the silver halide grains. The intergranular distribution of silver iodide content is monodisperse, so that the epitaxial deposition is uniform intergranularly. Generally, the EPMA (Electron Probe Micro Analyzer) method is effective in the measuring of the silver chloride or silver iodide content of each individual grain. In this method, a sample wherein emulsion grains are dispersed so as to avoid contacting thereof to each other is prepared. The sample is irradiated with electron beams to thereby emit X-rays. Analysis of the X-rays enables performing an elemental analysis of an extremely minute region irradiated with electron beams. The measuring is preferably performed while cooling the sample to low temperatures in order to prevent the damaging of the sample by electron beams.

In the emulsion of the present invention, 50% or more (numerical ratio) of all the grains each have a total of six silver halide epitaxial junction portions each exsiting selectively in each of six apex portions of hexagonal host tabular grains. Preferably, 70% or more (numerical ratio) of all the grains are tabular grains each having a total of six epitaxial junction portions each exsiting in each of six apex portions of hexagonal grains. Herein, each of the apex portions refers to part of a sector defined by one of the apexes as a center and two sides defining the one apex, which part is a sectorial portion formed with a radius corresponding to ⅓ of the length of shorter side among the two sides, as viewed in the direction perpendicular to main planes of the tabular grains. The greater the proportion of occupancy by grains having epitaxial junction portions in six apex portions, the greater the advantage of the present invention. When the main planes of tabular grains have a rounded triangular or hexagonal shape, the apexes and sides of main planes refer to those of a virtual triangle or hexagon formed by extending the sides of each of the main planes. Generally, in the tabular grains other than those of the epitaxial emulsion of the present invention, epitaxial junction portions are formed on main planes outside the apex portions or on sides outside the apex portions. By contrast, the present invention is characterized in that epitaxial junction portions are selectively provided on only the apex portions of hexagonal grains, not provided on main planes outside the apex portions or on sides outside the apex portions.

The epitaxial junction portion is silver chloride, silver bromochloride, or silver bromochloroiodide. The silver chloride content of this epitaxial junction portion is higher by preferably 1 mol % or more, and more preferably, 10 mol % or more, than that of a host tabular grain. However, the silver chloride content of the epitaxial junction portion is preferably 50 mol % or less. The silver bromide content of the epitaxial junction portion is preferably 30 mol % or more, and particularly preferably, 50% or more. The silver iodide content of the epitaxial junction portion is preferably 1 to 20 mol %. The silver amount in the epitaxial junction portion is preferably 1 to 10 mol %, and more preferably, 2 to 7 mol % of the silver amount in a host tabular grain.

In the emulsion of the present invention, 50% or more (numerical ratio) of all grains are occupied by tabular grains having at least one dislocation line per grain in the epitaxial junction portion thereof. Preferably, 70% or more (numerical ratio) of all grains are occupied by tabular grains having at least one dislocation line per grain in the epitaxial junction portion thereof. More preferably, in an emulsion of the present invention, 50% or more (numerical ratio) of all grains are occupied by tabular grains having mesh-like dislocation lines in the epitaxial junction portion thereof. Most preferably, 70% or more (numerical ratio) of all grains are occupied by tabular grains having mesh-like dislocation lines in the epitaxial junction portion thereof. Mesh-like dislocation lines mean a plurality of uncountable dislocation lines crossing each other like a mesh. In a tabular grain having epitaxial junction portions joined to two or more apex portions, dislocation lines do not necessarily exist in each epitaxial junction portion. An emulsion in which the epitaxial junction portion joined to at least one apex portion contains one dislocation line, and preferably, mesh-like dislocation lines, is the epitaxial emulsion of the present invention. Preferably, 70% or more in number ratio of the total epitaxial junction portions joined to apex portions have mesh-like dislocation lines. In the present invention, it is preferable that 70% or more (numerical ratio) of all grains are occupied by grains having no dislocation lines in portions except for the epitaxial junction portions. Dislocation lines provide preferential deposition sites of epitaxial deposition. Therefore, if dislocation lines exist in portions except for the epitaxial junction portions, it inhibits the formation of epitaxial tabular grains of the present invention. Preferably, 70% or more (numerical ratio) of all grains are occupied by grains in which the number of dislocation lines is zero in portions except for the epitaxial junction portions. Most preferably, 90% or more of the total projected area are occupied by grains in which the number of dislocation lines is zero in portions except for the epitaxial junction portions.

Dislocation lines in tabular grains can be observed by a direct method using a transmission electron microscope at a low temperature described in, e.g., J. F. Hamilton, Phot. Sci. Eng., 11, 57, (1967) or T. Shiozawa, J. Soc. Phot. Sci. Japan, 35, 213, (1972). That is, silver halide grains, extracted carefully from an emulsion so as not to apply a pressure at which dislocation lines are produced in the grains, are placed on a mesh for electron microscopic observation. Observation is performed by a transmission method while the sample is cooled to prevent damage (e.g., printout) due to an electron beam. In this case, as the thickness of a grain increases, it becomes more difficult to transmit an electron beam through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocation lines in each grain viewed in a direction perpendicular to the main planes of the grain.

In the emulsion of the present invention, preferably 70% or more, and more preferably 80% or more of the total projected area are occupied by tabular grains which do not epitaxially join stepwise onto the main planes in the apex portions of host tabular grains, but which epitaxially join by extending to side faces of host tabular grains. A tabular grain which epitaxially joins by extending from apexes of the main planes to side faces of a host tabular grain is distinguished as follows from a tabular grain which epitaxially joins stepwise onto the main planes in apex portions of a host tabular grain. 100 or more grains are extracted at random from an electron micrograph of tabular grains taken by the replica method. A grain in which the area of portions not overlapping the apex portions and extending to side faces accounts for 60% or more of the total projected area of the epitaxial junction portions of that grain is defined as a tabular grain which epitaxially joins by extending to side faces of a host tabular grain. If control is not performed so as to keep this shape after epitaxial deposition, the epitaxial junction is rearranged, and thereby dislocation lines disappear.

The epitaxial tabular emulsion of the present invention meeting the above conditions can lower its pBr. The pBr is the logarithm of the reciprocal of a bromine ion concentration. Since the pBr at 40° C. can be decreased to 3.5 or less, the storagebility can be significantly improved. Additionally, the problem of processing dependence can be solved because the emulsion can be incorporated into a lightsensitive material for photography which is constructed using silver bromoiodide as a basic constituent element. The pBr at 40° C. of an emulsion of the present invention is more preferably 3.0 or less, and most preferably, 2.5 or less.

Particular process for preparing the above epitaxial grains of the present invention will be described in detail below in two parts, the one for the preparation of host tabular grains and the other for the preparation of epitaxial junction portions.

First, the host tabular grains required for the preparation of the epitaxial grains of the present invention will be described. With respect to the intragranular distribution of silver iodide in the host tabular grains of the present invention, grains of double or more multiple structures are preferred. Herein, the expression "having structures with respect to the distribution of silver iodide" means that there is a difference in silver iodide content of 0.5 mol % or more, preferably 1 mol % or more, between structures. The "outermost layer" of a host tabular grain used in the present invention is the outermost layered phase in the multiple structures with respect to the silver iodide distribution.

Structures with respect to the distribution of silver iodide can fundamentally be determined by calculation from formulation values for the step of grain preparation. The change of silver iodide content at each interface of structures can be sharp or gentle. In the ascertation thereof, although an analytical measuring precision must be considered, the aforementioned EPMA method is effective. This method enables analyzing the intragranular silver iodide distribution as viewed from a position perpendicular to the main plane of tabular grains. Further, by using a specimen obtained by hardening the grain specimen and slicing the hardened specimen with the use of a microtome into extremely thin sections, the method also enables analyzing the intragranular silver iodide distribution across the tabular grain section.

In the present invention, it is preferred that the silver iodide content in the outermost layer of the host tabular grain be 10 mol % or more. The ratio of the outermost layer is preferably 20% or less, and more preferably 5 to 20% based on the total silver quantity. The silver iodide content thereof is preferably in the range of 3 to 30 mol %. Herein, the ratio of the outermost layer refers to the ratio of the amount of silver used in the preparation of the outermost layer to the amount of silver used for obtaining final grains. The silver iodide content refers to the molar ratio % of the amount of silver iodide used in the preparation of the outermost layer to the amount of silver used in the preparation of the outermost layer. The distribution thereof may be uniform or nonuniform. When the distribution of silver iodide content is nonuniform, the iodide content is an average value in the outermost layer. More preferably, the ratio of outermost layer is in the range of 10 to 15% based on the total silver quantity and the silver iodide content thereof is in the range of 15 to 30 mol %.

The preparation of host tabular grains fundamentally consists of a combination of three steps, namely, nucleation, ripening and growth.

In the step of nucleation of grains for use in the present invention, it is extremely advantageous to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the present invention, most preferably, an aqueous solution of silver nitrate, an aqueous solution of halide and an oxidation-processed gelatin of low molecular weight are added within one minute at 20 to 40° C. under agitation in the presence of oxidation-processed gelatin of low molecular weight. At that time, the pBr and pH values of the system are preferably 2 or higher and 7 or below, respectively. The concentration of the aqueous solution of silver nitrate is preferably 0.6 mol/L or less. The employment of this nucleation method facilitates the formation of the epitaxial grains of the present invention.

In the step of ripening the tabular grain emulsion of the present invention, it is practical to effect ripening in the presence of low-concentration base as described in U.S. Pat. No. 5,254,453, and to carry out ripening at high pH as described in U.S. Pat. No. 5,013,641. It is also practical to add, at the step of ripening or subsequent growth, polyalkylene oxide compounds as described in U.S. Pat. Nos. 5,147,771, 5,147,772, 5,147,773, 5,171,659, 5,210,013 and 5,252,453. In the present invention, the ripening step is preferably performed at 50 to 80° C. Immediately after the nucleation or during the ripening, the pBr is preferably lowered to 2 or below. Additional gelatin is preferably added from immediately after the nucleation to the end of ripening. Most preferred gelatin is one having 95% or more of its amino groups modified into succinate or trimellitate. The employment of such gelatins facilitates the formation of the epitaxial grains of the present invention.

In the step of growth for the present invention, it is preferably employed to simultaneously add an aqueous solution of silver nitrate, an aqueous solution of halide containing a bromide and a silver iodide fine grain emulsion as described in U.S. Pat. Nos. 4,672,027 and 4,693,964. The silver iodide fine grain emulsion is not limited if it consists substantially of silver iodide, and may contain silver bromide and/or silver chloride as long as mixed crystals can be formed. Preferably, the silver halide composition of the silver iodide fine grain emulsion consists of 100% silver iodide. With respect to the crystalline structure, the silver iodide can have not only β form and γ form but also, as described in U.S. Pat. No. 4,672,026, α form or a structure similar thereto. In the present invention, although the crystalline structure is not particularly limited, it is preferred to employ a mixture of β form and γ form, more preferably β form only. Although the silver iodide fine grain emulsion may be one prepared immediately before the addition as described in, for example, U.S. Pat. No. 5,004,679, or one having undergone the customary washing. The silver iodide fine grain emulsion can be easily prepared by the methods as described in, for example, U.S. Pat. No. 4,672,026. The method of adding an aqueous solution of silver salt and an aqueous solution of iodide by double jet, wherein the grain formation is carried out at a fixed pI value, is preferred. The terminology "pI" used herein means the logarithm of reciprocal of $I^-$ ion concentration of the system. Although there is no particular limitation with respect to the temperature, pI, pH, type of protective colloid agent such as gelatin, concentration thereof, presence of silver halide solvent, type and concentration thereof, etc., it is advantageous in the present invention that the grain size be 0.1 μm or less, preferably 0.07 μm or less. Although the grain configuration cannot be fully specified because of the fine grains, it is preferred that the variation coefficient of the grain size distribution be 25% or less. When it is 20% or less, the advantageous effect of the present invention is especially striking. The size and size distribution of the silver iodide fine grain emulsion are determined by placing silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of observed grain. With respect to the grain size distribution as well, it is determined by the use of the above diameter of a circle having the same projected area. In the present invention, the most effective silver iodide fine grains have a grain size of 0.06 to 0.02 μm and exhibit a variation coefficient of grain size distribution of 18% or less.

After the above grain formation, the silver iodide fine grain emulsion is preferably subjected to, as described in, for example, U.S. Pat. No. 2,614,929, the customary washing, the regulation of pH, pI and concentration of protective colloid agent such as gelatin, and the regulation of concentration of contained silver iodide. The pH is preferably in the range of 5 to 7. The pI value is preferably set at one minimizing the solubility of silver iodide or one higher than the same. Common gelatin having an average molecular weight of about 100,000 is preferably used as the protective colloid agent. Also, low-molecular-weight gelatins having an average molecular weight of 20,000 or less are preferably used. There are occasions in which the use of a mixture of such gelatins having different molecular weights is advantageous. The gelatin amount per kg of emulsion is preferably in the range of 10 to 100 g, more preferably 20 to 80 g. The silver quantity in terms of silver atom per kg of emulsion is preferably in the range of 10 to 100 g, more preferably 20 to 80 g. Although the silver iodide fine grain emulsion is generally dissolved prior to the addition, it is requisite that the agitating efficiency of the system be satisfactorily high at the time of the addition. The agitation rotating speed is preferably set higher than usual. The addition of an antifoaming agent is effective in preventing the foaming during the agitation. Specifically, use is made of antifoaming agents set forth in, for example, Examples of U.S. Pat. No. 5,275,929.

The method most preferably employed in the growth step for the present invention is one described in JP-A-2-188741. In the growth of tabular grains, an ultrafine grain emulsion of silver bromide, silver iodobromide or silver iodochlorobromide, prepared just before the addition, is continuously added so that the ultrafine grain emulsion is dissolved to thereby accomplish growth of tabular grains. An external mixer for preparing the ultrafine grain emulsion has high agitation capacity, and an aqueous solution of silver nitrate, an aqueous solution of halide and gelatin are fed into the external mixer. Gelatin can be mixed with an aqueous solution of silver nitrate and/or an aqueous solution of halide in advance or just before the addition. Also, an aqueous solution of gelatin can be added alone. Gelatins having a molecular weight smaller than the ordinary are preferred. It is especially preferred that the molecular weight thereof be in the range of 10,000 to 50,000. Gelatin having 90% or more of its amino groups modified into phthalate, succinate or trimellitate and/or oxidation-processed gelatin of reduced methionine content can especially preferably be used. The use of this growth method facilitates the formation of the epitaxial grains of the present invention.

It is especially preferred in the present invention that 75% or less of all the side faces connecting the opposite (111) main planes of host tabular grains consist of (111) faces.

The expression "75% or less of all the side faces consist of (111) faces" used herein means that crystallographic faces other than the (111) faces are present at a ratio higher than 25% based on all the side faces. The other faces, although generally understandable as consisting of (100) faces, are not limited thereto and can comprise (110) faces and faces of higher indices. The effect of the present invention is remarkable when 70% or less of all the side faces consist of (111) faces.

Whether 75% or less of all the side faces consist of (111) faces or not can easily be judged from an electron micrograph obtained by the carbon replica method in which the tabular grain is shadowed. When at least 75% of all the side faces consist of (111) faces, with respect to a hexagonal tabular grain, six side faces directly connected to the (111) main planes are generally alternately connected to the (111) main planes with acute angles and obtuse angles. On the other hand, when 75% or less of all the side faces consist of (111) faces, with respect to a hexagonal tabular grain, six side faces directly connected to the (111) main planes are all connected to the (111) main planes with obtuse angles. Whether the side faces are connected to the main planes with acute angles or with obtuse angles can be judged by effecting the shadowing at an angle of 50° or less. Preferably, the judgment between acute angles and obtuse angles is facilitated by effecting the shadowing at an angle of 30° to 10°.

The method of utilizing the adsorption of a sensitizing dye is effective in determining the ratio of (111) faces to (100) faces. The ratio of (111) faces to (100) faces can be quantitatively determined by the application of the method described in Journal of the Chemical Society of Japan, 1984, vol. 6, pp. 942–947. The ratio of (111) faces to all the side faces can be calculated from the above ratio of (111) faces to (100) faces and the aforementioned equivalent circle diameter and thickness of the tabular grain. In this instance, the tabular grain is assumed as a cylinder with the equivalent circle diameter and thickness. Under this assumption, the ratio of the side faces to the total surface area can be determined. The ratio of (100) faces to all the side faces is a value obtained by dividing the above ratio of (100) faces determined on the basis of the adsorption of sensitizing dye by the above side face ratio and multiplying the resultant quotient by 100. The ratio of (111) faces to all the side faces is determined by subtracting this value from 100. In the present invention, it is more preferred that the ratio of (111) faces to all the side faces be 65% or less.

The method for causing 75% or less of all the side faces of the host tabular grain emulsion to consist of (111) faces will now be described. Most generally, the ratio of (111) faces to the side faces of the host tabular grain emulsion can be regulated by pBr at the preparation of the tabular grain emulsion. Preferably, 30% or more of the silver quantity required for the formation of the outermost layer is added at a pBr set so that the ratio of (111) faces to the side faces is decreased, that is, the ratio of (100) faces to the side faces is increased. More preferably, 50% or more of the silver quantity required for the formation of the outermost layer is added at a pBr set so that the ratio of (111) faces to the side faces is decreased.

As an alternative method, after the addition of the whole silver quantity, pBr is so set that the ratio of (100) faces to the side faces is increased, followed by ripening to thereby attain an increase of the ratio.

With respect to such pBr as will increase the ratio of (100) faces to the side faces, the value thereof can be widely varied depending on the temperature and pH of system, type of protective colloid agent such as gelatin, concentration thereof, presence of silver halide solvent, type and concentration thereof, etc. Generally, it is preferred that the pBr be in the range of 2.0 to 5. More preferably, the pBr is in the range of 2.5 to 4.5. However, as mentioned above, this pBr value can be easily changed, for example, depending on the presence of a silver halide solvent, etc. Examples of silver halide solvents which can be used in the present invention include organic thioethers (a) described in U.S. Pat. Nos. 3,271,157, 3,531,286 and 3,574,628 and JP-A's-54-1019 and 54-158917; thiourea derivatives (b) described in JP-A's-53-82408, 55-77737 and 55-2982; silver halide solvents having a thiocarbonyl group interposed between an oxygen or sulfur atom and a nitrogen atom (c) described in JP-A-53-144319; imidazoles (d) described in JP-A-54-100717; sulfites (e); ammonia (f) and thiocyanates (g).

Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halide.

With respect to the method of changing the face index for the side faces of the tabular grain emulsion, reference can be made to, for example, EP No. 515894A1. Further, use can be made of polyalkylene oxide compounds described in, for example, U.S. Pat. No. 5,252,453. As an effective method, there can be mentioned the use of face index improvers described in, for example, U.S. Pat. Nos. 4,680,254, 4,680,255, 4,680,256 and 4,684,607. Conventional photographic spectral sensitizing dyes can also be used as similar face index improvers.

It is preferred that the host tabular grains have no dislocation lines. Dislocation lines can be vanished by the use of the above nucleation, ripening and growth steps in combination.

Epitaxial junctions necessary for the preparation of the epitaxial emulsion of the present invention will be described in detail below. Epitaxial deposition can be performed immediately after the formation of host tabular grains, or after normal desalting is performed after the formation of host tabular grains.

Before this epitaxial deposition, an emulsion favorably contains gelatin which, in a molecular weight distribution measured on the basis of the PAGI method, contains 5% to 30% of a high-molecular-weight component having a molecular weight of approximately 2,000,000 or more and 55% or less of a low-molecular-weight component having a molecular weight of approximately 100,000 or less. Particularly favorably, the emulsion contains gelatin which, in the molecular weight distribution measured on the basis of the PAGI method, contains 5% to 15% of a high-molecular-weight component having a molecular weight of approximately 2,000,000 or more and 50% or less of a low-molecular-weight component having a molecular weight of approximately 100,000 or less. When epitaxial junction is performed, the high-molecular-weight gelatin having the above defined components is contained in an amount of 10 mass %, preferably, 30 mass % or more, and more preferably, 50 mass % or more of the total gelatin amount. Although the addition of this gelatin before coating is effective, the effect is small.

Gelatin used in the emulsion of the present invention (to be also referred to as "gelatin of the present invention" hereinafter) is formed by giving water solubility to a collagen tissue by decomposing its structure with alkali or acid. Alkali-processed gelatin consists, on the basis of its molecular weight, of sub-α (low molecular weight), α (molecular weight=about 100,000), β (molecular weight=about 200,000), γ (molecular weight=about 300,000), and void (higher molecular weight).

The ratio of gelatin components, i.e., the molecular weight distribution in the present invention is measured by gel permeation chromatography (to be referred to as "GPC" hereinafter) on the basis of the PAGI method which is internationally determined. Details of GPC are described in, e.g., Takashi Ohno, Hiroyuki Kobayashi, and Shinya Mizusawa, "The Journal of Japan Photographic Society", Vol. 47, No. 4, 1984, pp. 237 to 247.

The measurement conditions of the molecular weight distribution of gelatin according to the present invention are presented below.

(Measurement Conditions)

Column: Shodex Asahipak GS-620 7G (8 mm I.D.×500 mm)×2

Guard column: Shodex Asahipack GS-1G 7B

Eluting solution: 0.2 mol/litter phosphoric acid buffer (pH 6.8)

Flow rate: 0.8 milliliter/min

Column temperature: 5° C.

Detection: UV 230 nm

Sample concentration: 0.5 wt %

On a GPC curve obtained by plotting the retention time on the abscissa and the absorbance on the ordinate, the peak of the exclusion limit first appears, and then the peaks of the β and α components of gelatin appear. The curve forms a long tail as the retention time prolongs.

In the present invention, the ratio occupied by a high-molecular-weight component having a molecular weight of about 2,000,000 or more is obtained by calculating the ratio which the area of the peak of the exclusion limit accounts for in the whole area. More specifically, a perpendicular is drawn to the abscissa from a minimum point which appears on the GPC curve when the retention time is about 17 min. The ratio which the area of a portion (high-molecular-weight component) on the high-molecular-weight side of the perpendicular accounts for in the whole area is calculated. Also, the ratio occupied by a low-molecular-weight component having a molecular weight of about 100,000 or less is obtained by calculating the ratio which the α and subsequent components account for in the whole area. More specifically, a perpendicular is drawn to the abscissa from a minimum point which appears on the GPC curve between the β and α component peaks when the retention time is about 23 min. The ratio which the area of a portion (low-molecular-weight component) on the low-molecular-weight side of the perpendicular accounts for in the whole area is calculated.

In the gelatin of the present invention, the high-molecular-weight component having a molecular weight of about 2,000,000 or more is regulated in the range of 5% to 30%, and the low-molecular-weight component having a molecular weight of about 100,000 or less is regulated in the range of 55% or less. If the high-molecular-weight component exceeds 30%, the filtering characteristics abruptly worsen. Also, if the low-molecular-weight component is larger than 55% and/or the high-molecular-weight component is smaller than 5%, the effect of the present invention is not well achieved. To achieve the effect of the present invention, it is particularly favorable that the high-molecular-weight component having a molecular weight of about 2,000,000 or more be 5% to 15%, and the low-molecular-weight component having a molecular weight of about 100,000 or less be 50% or less.

The gelatin of the present invention can also be subjected to various modification processes. Examples are phthalated gelatin having a modified amino group, succinated gelatin, trimellitic gelatin, pyromellitic gelatin, esterified gelatin having a modified carboxyl group, amidized gelatin, formylated gelatin having a modified imidazole group, oxidation-processed gelatin having a reduced methionine group, and reduction-processed gelatin having an increased methionine group.

Also, use can be made of other hydrophilic colloids.

For example, use can be made of a variety of synthetic hydrophilic polymeric materials including proteins such as gelatin derivatives, graft polymers from gelatin/other polymers, albumin and casein; sugar derivatives, for example, cellulose derivatives such as hydroxyethylcellulose, carboxymethylcellulose and cellulose sulfate esters, sodium alginate and starch derivatives; and home- or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole. Suitable gelatins include, for example, not only lime treated gelatins but also acid treated gelatins and, further, enzyme treated gelatins as described in Bull. Soc. Sci. Photo. Japan, No. 16, p.30 (1966). Also, use can be made of gelatin hydrolyzates and enzymolyzates.

The pH, pAg, type and concentration of gelatin and viscosity are selected for the preparation of the epitaxial grains of the present invention. In particular, the pH is important, and is preferably 4 to 5.5. More preferably, it is in the range of 4.5 to 5. When the epitaxial grains are prepared at such a pH value, the epitaxial deposition would occur uniformly among the grains, by which the advantages of the present invention become remarkable.

A sensitizing dye is used as a site-directing agent (or site director) for the epitaxial junction. The position of epitaxial deposition can be controlled by selecting the amount and type of employed sensitizing dye. Dye is preferably added in an amount of 50 to 90% based on a saturated coating quantity. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes. Any of nuclei commonly used in cyanine dyes as basic heterocyclic nuclei can be employed in these dyes. That is, there can be employed, for example, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzoimidazole nucleus and a quinoline nucleus. These nuclei may have substituents on carbon atoms thereof.

These sensitizing dyes may be used either individually or in combination. The sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB Nos. 1,344,281 and 1,507,803, JP-B's-43-4936 and 53-12375, and JP-A's-52-110618 and 52-109925.

The emulsion of the present invention may be loaded with a dye which itself exerts no spectral sensitizing effect or a substance which absorbs substantially none of visible light and exhibits supersensitization, simultaneously with or separately from the above sensitizing dye.

Increased silver iodide content in the extreme surface composition of host tabular grains at the time of adsorption of sensitizing dye is preferred from the viewpoint of preparation of epitaxial grains. Thus, addition of iodide ions is effected prior to the incorporation of sensitizing dye. In the present invention, it is most preferably employed to add the aforementioned AgI fine grain emulsion to thereby increase the silver iodide content of the surface of host tabular grains. This renders the intergranular distribution of silver iodide content uniform and renders the adsorption of sensitizing dye uniform. As a result, the preparation of epitaxial grains of the present invention can be realized. The addition amount of such iodide ions or silver iodide is preferably in the range of $1\times10^{-4}$ to $1\times10^{-2}$ mol, more preferably $1\times10^{-3}$ to $5\times10^{-3}$ mol, per mol of the silver amount of host tabular grains.

With respect to the method of forming epitaxial junction portions, a solution containing halide ions and a solution containing $AgNO_3$ may be added simultaneously or separately. Alternatively, the formation may be effected by carrying out the addition in appropriate combination with, for example, the addition of AgCl fine grains, AgBr fine grains or AgI fine grains all having a grain diameter smaller than that of host tabular grains, or the addition of mixed crystal grains thereof. In the addition of the $AgNO_3$ solution, the addition time is preferably in the range of 30 sec to 10 min, more preferably 1 to 5 min. For the formation of the epitaxial grains of the present invention, the concentration of added silver nitrate solution is preferably 1.5 mol/L or less (hereinafter liter is also referred to as "L"), more preferably 0.5 mol/L or less. At that time, the agitation of the system must be carried out efficiently, and, with respect to the viscosity of the system, the lower, the more preferable.

The silver quantity of epitaxial junction portions is preferably in the range of 1 to 10 mol %, more preferably 2 to 7 mol %, based on the silver quantity of host tabular grains. When the silver quantity is too small, the epitaxial grains cannot be prepared. On the other hand, when the silver quantity is too large, the resultant epitaxial grains are unstable.

At the formation of epitaxial junction portions, the pBr is preferably 3.5 or more, more preferably 4.0 or more. The temperature is preferably in the range of 35 to 45° C. At the formation of epitaxial junction portions, it is preferred that the emulsion be doped with a hexa-cyano metal complex.

Among the hexa-cyano metal complex, those containing iron, ruthenium, osmium, cobalt, rhodium, iridium or chromium are preferable. The addition amount of the metal complex is preferably within the range of $10^{-9}$ to $10^{-2}$ per mol of the total silver halide of the epitaxial junction portion and the host portion, and more preferably within the range of $10^{-8}$ to $10^{-4}$ mol. The metal complex can be added by dissolving it to water or a organic solvent. The organic solvent is preferably miscible with water. As examples of the organic solvent, alcohols, ethers, glycols, ketons, esters, and amides are included.

As the metal complexes, hexa-cyano metal complexes represented by the following formula (I) is especially preferable. The hexa-cyano metal complex has advantages of attaining high-sensitive lightsensitive material, and suppressing fogging from arising even when a raw lightsensitive material is stored for a long period of time.

$$[M(CN)_6]^{n-} \quad \text{(I)}$$

wherein M represents iron, ruthenium, osmium, cobalt, rhodium, iridium or chromium, and n represents 3 or 4.

Specific examples of the hexa-cyano metal complexes are set forth below:

$$[Fe(CN)_6]^{4-} \quad \text{(I-1)}$$

$$[Fe(CN)_6]^{3-} \quad \text{(I-2)}$$

$$[Ru(CN)_6]^{4-} \quad \text{(I-3)}$$

$$[Os(CN)_6]^{4-} \quad \text{(I-4)}$$

$$[Co(CN)_6]^{3-} \quad \text{(I-5)}$$

$$[Rh(CN)_6]^{3-} \quad \text{(I-6)}$$

$[Ir(CN)_6]^{3-}$ (I-7)

$[Cr(CN)_6]^{4-}$ (I-8)

For the counter cations of the hexa-cyano complex, those easily miscible with water, and suitable for precipitation procedure of a silver halide emulsion are preferably used. Examples of the counter ions include alkali metal ions (e.g., sodium ion, potassium ion, rubidium ion, cesium ion and lithium ion), ammonium ion and alkylammonium ion.

Into the emulsion of the present invention, the aforementioned sensitizing dyes and/or antifoggants and/or stabilizers to be described later are preferably added.

In the present invention, it is preferable to decrease pBr after this. In epitaxial emulsions outside the scope of the present invention, destruction of epitaxial occurs by this pBr decrease, which results in a photographic material whose sensitivity is low. On the other hand, in the epitaxial emulsion of the present invention, this pBr decrease can be realized, thereby advantages in storagebility and processability can be attained remarkably. Preferably, the pBr is lowered to 3.5 or less at 40° C., more preferably, the pBr is 3.0 or less at 40° C. Especially preferably, the pBr is 2.5 or less. Decreasing pBr is basically performed by adding bromide ions, for example, KBr and NaBr. After the epitaxial deposition, washing is usually performed.

Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is preferable that the emulsion of the present invention be chemically sensitized after epitaxial deposition. One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

In the tellurium sensitization, labile tellurium compounds, such as hose described in JP-A's-4-224595, 4-271341, 4-333043, 5-303157, 6-27573, 6-175258, 6-180478, 6-208184, 6-208186, 6-317867, 7-140579, 7-301879, and 7-301880, may be used.

More specifically, phosphinetellurides (e.g., n-butyldiisopropylphosphinetelluride, triisobutylphosphinetelluride, tri-n-butoxyphosphinetelluride, triisopropylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride), telluroureas (e.g., N,N'-dimethylethylenetellurourea), telluroamides, telluroesters may be used. Preferably, phosphynetellurides and diacyl(di)tellurides may be used.

Photographic emulsions used in the present invention can contain various compounds in order to prevent fog during the manufacturing process, storage, or photographic processing of a sensitized material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly hydroxy-substituted(1,3,3a,7)tetrazaindenes), and pentazaindenes. For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, during epitaxial formation, before, during, and after chemical sensitization, and before coating, in accordance with the intended application. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

In the preparation of the emulsion of the invention, it is preferable to make salt of metal ion exist, for example, during grain formation, epitaxial formation, desalting, or chemical sensitization, or before coating in accordance with the intended use. The metal ion salt is preferably added during grain formation when doped into grains. The metal ion salt is preferably added after grain formation and before completion of chemical sensitization when used to decorate the grain surface or used as a chemical sensitizer. The salt can be doped in any of an overall grain, only the core of a grain, and only the shell of a grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in water or an appropriate organic solvent such as methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also preferable to combine several different addition methods.

The silver halide photographic emulsion of the present invention preferably contains a grain that is provided with a positive hole-capturing zone in at least a host portion of the inside of the grain by performing reduction sensitization during grain formation or after grain formation. The positive hole-capturing zone indicates a region having a function of capturing a positive hole generated in pair with photo-electron generated by, for example, photo-excitation. As a method of providing such positive hole-capturing zone, a method using a dopant is known, but the zone is preferably provided by an intentional reduction sensitization in the present invention. A method of reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The intentional reduction sensitization in the present invention means an operation of introducing a positive hole-capturing silver nuclei into a portion or all of the inside of the silver halide grains by adding a reduction sensitizing agent. The positive hole-capturing silver nuclei means a small silver nuclei having a little development activity, and the recombination loss at a lightsensitive process is prevented by the silver nuclei and the sensitivity can be enhanced.

The method of adding reduction sensitizers is preferred in that the level of reduction sensitization can be finely adjusted. Known examples of the reduction sensitizer are stannous chloride, ascorbic acid and its derivatives, amines and polyamines, hydrazine derivatives, formamidinesulfinic acid, a silane compound, and a borane compound. In reduction sensitization utilized in the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-3}$ mol per mol of a silver halide.

The reduction sensitizer is, for example, added during grain formation by dissolving thereof to water, or organic solvents such as alcohols, glycols, ketones, esters, and amides.

It is preferable to use an oxidizer for silver during the process of manufacturing emulsions of the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers used in the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be performed at a grain formation step or a chemical sensitization step.

The lightsensitive material using a silver halide emulsion of the present invention, it is only required that at least one silver halide emulsion layer be formed on a support. Preferably, at least one blue-sensitive layer, at least one green-sensitive layer and at least one red-sensitive layer are provided on a support, and at least one of these color sensitive layers is preferably constituted by two or more layers which have different sensitivity. Both the number and the arrangement order of silver halide emulsion layers and nonlightsensitive layers are not particulary limited. A typical example is a silver halide photographic lightsensitive material having, on its support, at least one lightsensitive layer constituted by a plurality of silver halide emulsion layers which are sensitive to essentially the same color but have different sensitivity. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color.

Nonlightsensitive layers can be formed between the silver halide lightsensitive layers and as the uppermost layer and the lowermost layer. These nonlightsensitive layers may contain couplers and DIR compounds such as those described in JP-B's-61-43748, 59-113438, 59-113440, and 61-20037. These nonlightsensitive layers may also contain color-mixing inhibitors as used conventionally.

As a plurality of silver halide emulsion layers constituting each unit lightsensitive layer, a two-layered structure of high- and low-speed emulsion layers is preferably arranged so that the sensitivity is sequentially decreased toward a support as described in DE No. 1,121,470 or GB No. 923,045. Also, as described in JP-A's-57-112751, 62-200350, 62-206541 and 62-206543, layers can be arranged so that a low-speed emulsion layer is formed on a side apart from a support while a high-speed emulsion layer is formed on a side close to the support.

More specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, layers can be arranged, from the farthest side from a support, in the order of blue-sensitive layer/GH/RH/GL/RL. Furthermore, as described in JP-A's-56-25738 and 62-63936, layers can be arranged, from the farthest side from a support, in the order of blue-sensitive layer/GL/RL/GH/RH.

As described in JP-B-49-15495, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivity can be arranged such that the sensitivity is sequentially decreased toward the support. Even when a layer structure is constituted by three layers having different sensitivity, these layers can be arranged in the order of medium-speed emulsion layer/high-speed emulsion layer/low-speed emulsion layer from the farthest side from a support in a layer sensitive to one color, as described in JP-A-59-202464.

In addition, the order of high-speed emulsion layer/low-speed emulsion layer/medium-speed emulsion layer or the order of low-speed emulsion layer/medium-speed emulsion layer/high-speed emulsion layer can be adopted.

A layer in which an emulsion of the present invention is used may be any of a low-speed emulsion layer, medium-speed emulsion layer, and high-speed emulsion layer. As a silver halide emulsion having no epitaxial junction, it is possible to preferably use tabular-grain emulsions containing dislocation lines in fringe portions, described in, e.g., JP-A's-11-174606 and 11-295832. This method of use can improve the performance of a lightsensitive material and can also reduce the silver coating amount. The silver amount (the weight in units of silver atoms) of an emulsion used in each emulsion layer is preferably 0.3 to 3 $g/m^2$, and more preferably, 0.5 to 2 $g/m^2$.

Furthermore, the arrangement can be changed as described above even when four or more layers are formed.

As described above, various structure and arrangement of these layers can be selected according to respective purpose of lightsensitive materials.

The above various additives can be used in the lightsensitive material according to the present invention, to which other various additives can also be added in conformity with the object.

These additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| | Types of additives | RD17643 | RD18716 | RD308119 |
|---|---|---|---|---|
| 1 | Chemical-sensitizers | page 23 | page 648 right column | page 996 |
| 2 | Sensitivity increasing agents | | page 648 right column | |
| 3 | Spectral sensitizers, super-sensitizers | pages 23–24 | page 648, right column to page 649, right column | page 996, right column to page 998, right column |
| 4 | Brighteners | page 24 | | page 998 right column |
| 5 | Antifoggants, and stabilizers | pages 24–25 | page 649 right column | page 998, right column to page 1000, right column |

-continued

| | Types of additives | RD17643 | RD18716 | RD308119 |
|---|---|---|---|---|
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column to page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column. |

To prevent deterioration of the photographic properties caused by formaldehyde gas, a sensitive material of the present invention preferably contains a compound described in U.S. Pat. Nos. 4,411,987 or 4,435,503, which can react with and fix formaldehyde gas.

Various color couples may be used in the present invention, and the specific examples thereof are described in the patents described in the aforementioned Research Disclosure No. 17643, VII-C to G and No. 307105, VII-C to G.

Preferred yellow couplers are those described in, for example, U.S. Pat. Nos. 3,933,051, 4,022,620, 4,326,024, 4,401,752 and 4,248,961, JP-B-58-10739, British Patent Nos. 1,425,020 and 1,476,760, U.S. Pat. Nos. 3,973,968, 4,314,023 and 4,511,649, and European Patent No. 249, 473A.

Preferred magenta couplers are 5-pyrazolone and pyrazoloazole compounds. Particularly preferred are those described in U.S. Pat. Nos. 4,310,619 and 4,351,897, European Patent No. 73,636, U.S. Pat. Nos. 3,061,432 and 3,725,067, Research Disclosure No. 24220 (June, 1984), JP-A-60-33552, Research Disclosure No. 24230 (June, 1984), JP-A's-60-43659, 61-72238, 60-35730, 55-118034 and 60-185951, U.S. Pat. Nos. 4,500,630, 4,540,654 and 4,556,630, and International Publication No. WO 88/04795.

The cyan couplers usable in the present invention are phenolic and naphtholic couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Unexamined Published Application No. 3,329, 729, European Patent Nos. 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized color-forming couplers are described in, for example, U.S. Pat. Nos. 3,451, 820, 4,080,211, 4,367,282, 4,409,320 and 4,576,910, British Patent No. 2,102,137 and European Patent No. 341,188A.

The couplers capable of forming a colored dye having a suitable diffusibility are preferably those described in U.S. Pat. No. 4,366,237, British Patent No. 2,125,570, European Patent No. 96,570 and West German Patent (Publication) No. 3,234,533.

Colored couplers used for compensation for unnecessary absorption of the colored dye are preferably those described in Research Disclosure No. 17643, VII-G and No. 307105, VII-G, U.S. Pat. No. 4,163,670, JP-B-57-39413, U.S. Pat. Nos. 4,004,929 and 4,138,258 and British Patent No. 1,146, 368. Other couplers preferably used herein include couplers capable of compensating for an unnecessary absorption of the colored dye with a fluorescent dye released during the coupling as described in U.S. Pat. No. 4,774,181 and couplers having, as a removable group, a dye precursor group capable of forming a dye by reacting with a developing agent as described in U.S. Pat. No. 4,777,120.

Further, compounds which release a photo-graphically useful residue during a coupling reaction are also preferably usable in the present invention. DIR couplers which release a development inhibitor are preferably those described in the patents shown in the above described RD 17643, VII-F and No. 307105, VII-F as well as those descried in JP-A's-57-151944, 57-154234, 60-184248, 63-37346 and 63-37350 and U.S. Pat. Nos. 4,248,962 and 4,782,012.

The couplers which release a nucleating agent or a development accelerator in the image-form in the development step are preferably those described in British Patent Nos. 2,097,140 and 2,131,188 and JP-A's-59-157638 and 59-170840. Further, compounds capable of releasing a fogging agent, development accelerator, solvent for silver halides, etc. upon the oxidation-reduction reaction with an oxidate of a developing agent as described in JP-A's-60-107029, 60-252340, 1-44940 and 1-45687 are also preferred.

Other compounds usable for the lightsensitive material according to the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A's-60-185950 and 62-24252, couplers which release a dye that restores the color after coupling-off as described in European Patent Nos. 173,302 A and 313,308 A, ligand-releasing couplers described in U.S. Pat. No. 4,555,477, leuco dye-releasing couplers described in JP-A-63-75747 and fluorescent dye-releasing couplers described in U.S. Pat. No. 4,774,181.

Couplers used in the present invention can be introduced to a lightsensitive material by various known dispersion methods.

Examples of high-boiling solvent used in oil-in-water dispersion method are described in, e.g., U.S. Pat. No. 2,322,027.

Examples of the high-boiling organic solvent having a boiling point at normal pressure of 175° C. or more which are usable in the oil-in-water dispersion method are phthalic acid esters (e.g., dibutylphthalate, dicyclohexylphthalate, di-2-ethylhexylphthalate, decylphthalate, bis(2,4-di-tert-amylphenyl)phthalate, bis(2,4-di-tert-amylphenyl) isophthalate, and bis(1,1-diethylpropyl)phthalate); esters of phosphoric acid and esters of phosphonic acid (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate); benzoic acid esters (e.g., 2-ethylhexylbenzoate, dodecylbenzoate, and 2-ethylhexyl-p-hydroxybenzoate); amides (e.g., N,N-diethyldodecaneamide, N,N-diethyllaurylamide, and N-tetradecylpyrrolidone); alcohols and phenols (e.g., isostearyl alcohol and 2,4-di-tert-amylphenol); aliphatic carboxylic acid esters (e.g., bis(2-ethylhexyl)sebacate, dioctylazelate, glyceroltributylate,isostearyllactate, and trioctylcitrate); aniline derivatives (e.g., N,N-dibutyl-2-butoxy-5-tert-octylaniline); hydrocarbons (paraffins, dodecylbenzene, and diisopropylnaphthalene). As a co-solvent, it is also possible to use an organic solvent having a boiling point of about 30° C. to about 160° C., preferably about 50° C. to about 160° C. Typical examples of the co-solvent are ethyl acetate, butyl acetate, ethyl propionate, methylethylketone, cyclohexanone, 2-ethoxyethylacetate, and dimethylformamide).

Practical examples of steps, effects, and impregnating latexes of a latex dispersion method as one polymer dispersion method are described in, e.g., U.S. Pat. No. 4,199,363, West German Patent Application (OLS) Nos. 2,541,274 and 2,541,230.

The color lightsensitive material of the present invention preferably contains phenethyl alcohol or an antiseptic or mold-proofing agent described in JP-A's-63-257747, 62-272248 and 1-80941 such as 1,2-benzisothiazolin-3-one, n-butyl-p-hydroxybenzoate, phenol, 4-chloro-3,5-dimethylphenol, 2-phenoxyethanol or 2-(4-thiazolyl) benzimidazole.

The present invention can be applied to various lightsensitive materials, preferably various color lightsensitive materials. Representative examples of lightsensitive materials are color negative films for general purposes or movies, color reversal films for slides or television, color paper, color positive films, and color reversal paper. Also, the present invention can be particularly preferably applied to color dupe films.

A support which can be suitably used in the present invention is described in, e.g., RD. No. 17643, page 28, RD. No. 18716, page 647, right column to page 648, left column, and RD. No. 307105, page 879.

In a lightsensitive material of the present invention, the total film thickness of all hydrophilic colloid layers on the side having emulsion layers is preferably 28 μm or less, more preferably, 23 μm or less, most preferably, 18 μm or less, and particularly preferably, 16 μm or less. A film swell speed $T_{1/2}$ is preferably 30 sec or less, and more preferably, 20 sec or less. A film thickness means the thickness of a film measured under moisture conditioning at a temperature of 25° C. and a relative humidity of 55% (two days). A film swell speed $T_{1/2}$ can be measured according to a process known in the technical art. For example, $T_{1/2}$ can be measured by using a swell meter described in Photogr. Sci. Eng., A. Green et al., Vol. 19, No. 2, pp. 124 to 129. $T_{1/2}$ is defined as a time which the film thickness requires to reach ½ of a saturation film thickness which is 90% of a maximum swell film thickness reached when processing is performed by using a color developer at 30° C. for 3 min and 15 sec.

$T_{1/2}$ can be adjusted by adding a film hardening agent to gelatin as a binder or changing aging conditions after coating.

In a lightsensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A color lightsensitive material according to the present invention can be developed by conventional methods described in RD. No. 17643, pp. 28 and 29, RD. No. 18716, page 651, left to right columns, and RD No. 307105, pp. 880 and 881.

The color developer to be used in the development of the lightsensitive material of the present invention is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxy-ethylaniline, 3-methyl-4-amino-N-ethyl-N-β-methanesulfonamidoethylan iline, 3-methyl-4-amino-N-ethyl-β-methoxyethylaniline, and sulfates, hydrochlorides and p-toluenesulfonates thereof. Particularly preferred among these compounds are 3-methyl-4-amino-N-ethyl-N-β-hydroxyethylaniline sulfate. These compounds can be used in combination of two or more thereof depending on the purpose of application.

The color developer normally contains a pH buffer such as carbonate, borate and phosphate of an alkali metal, or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-biscarboxymethylhydrazine), phenylsemicarbazides, triethanolamine and catecholsulfonic acids; organic solvents such as ethylene glycol and diethylene glycol; development accelerators such as benzyl alcohol, polyethylene glycol, quaternary ammonium salts, and amines; color-forming couplers, competing couplers, auxiliary developing agents such as 1-phenyl-3-pyrazolidone; viscosity-imparting agents; various chelating agents exemplified by aminopolycarboxylic acids, aminopolyphosphonic acids, alkylphosphonic acids, and phosphonocarboxylic acids. Representative examples of chelating agents are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof.

Further, when reversal processing is to be performed on the photographic material, color development is usually performed after black-and-white development. As the black-and-white developer, known black-and-white developers can be used singly or in combination, which include dihydroxybenzenes such as hydroquinone, 3-pyrazolidones such as 1-phenyl-3-pyrazolidone, or aminophenols such as N-methyl-p-aminophenol. Theses color developer and black-and-white developer usually have a pH of from 9 to 12. The replenishment rate of these developers is usually 3L or less per $m^2$ of the lightsensitive material, though depending on the type of the color photographic lightsensitive material to be processed. The replenishment rate may be reduced to 500 milliliter/$m^2$ or less by decreasing the bromide ion concentration in the replenisher (hereinafter milliliter is also referred to as "mL"). If the replenishment rate is reduced, the area of the processing tank in contact with air is preferably reduced to inhibit the evaporation and air oxidation of the processing solution.

The area of the photographic processing solution in contact with air in the processing tank can be represented by an opening rate as defined by the following equation:

$$\text{Opening rate}=\{\text{area of processing solution in contact with air } (cm^2)\}/\{\text{volume of processing solution } (cm^3)\}$$

The opening rate as defined above is preferably 0.1 or less, more preferably 0.001 to 0.05. Examples of methods for reducing the opening rate include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening rate is preferably applied to all processing steps, i.e., not only to both color development and black-and-white development steps but also to the subsequent steps such as bleaching, bleach-fixing, fixing, washing and stabilizing steps. The replenishment rate can also be reduced by using a means for suppressing accumulation of the bromide ions in the developer.

The period for the color development processing usually sets between 2 to 5 min, the processing time can be shortened further by setting high pH and temperature, and using high concentration of color developing agent.

The photographic emulsion layer which has been color-developed is normally subjected to bleaching process. Bleaching process may be effected simultaneously with fixing process (i.e., bleach-fixing process), or these two processes may be carried out separately. For speeding up of processing, bleaching process may be followed by bleach-fixing process. Further, any of an embodiment wherein two bleach-fixing baths connected in series are used, an embodiment wherein bleach-fixation is preceded by fixation, and an embodiment wherein bleach-fixation is followed by bleach may be selected arbitrarily according to the purpose. Bleaching agents to be used include compounds of polyvalent metals, e.g., iron (III), peroxides (soda persulfate is particularly suitable for color negative film for movies), quinones, and nitro compounds. Typical examples of these bleaching agents are organic complex salts of iron (III), e.g., complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid, or complex salt with citric acid, tartaric acid, or malic acid. Of these, aminopolycarboxylic acid-iron (III) complex salts such as ethylenediaminetetraacetato iron (III) complex salts and 1,3-diaminopropanetetraacetato iron (III) complex salts are preferred in view of speeding up of processing and conservation of the environment. In particular, aminopolycarboxylic acid-iron (III) complex salts are useful in both of a bleaching solution and a bleach-fixing solution. The pH value of a bleaching solution or bleach-fixing solution comprising such an aminopolycarboxylic acid-iron (III) complex salts is normally in the range of 4.0 to 8. For speeding up of processing, the processing can be effected at an even lower pH value.

The bleaching bath, bleach-fixing bath or a pre-bath thereof can contain, if desired, a bleaching accelerator. Examples of useful bleaching accelerators include compounds having a mercapto group or a disulfide group as described in U.S. Pat. No. 3,893,858, West German Patents 1,290,812 and 2,059,988, JP-A's-53-32736, 53-57831, 53-37418, 53-72623, 53-95630, 53-95631, 53-104232, 53-124424, 53-141623, and 53-18426 and Research Disclosure No. 17129 (July 1978); thiazolidine derivatives as described in JP-A-51-140129; thiourea derivatives as described in JP-B-45-8506, JP-A's-52-20832, and 53-32735 and U.S. Pat. No. 3,706,561; iodides as described in West German Patent 1,127,715 and JP-A-58-16235; polyoxyethylene compounds as described in West German Patents 966,410 and 2,748,430; polyamine compounds as described in JP-B-45-8836; compounds as described in JP-A's-49-40943, 49-59644, 53-94927, 54-35727, 55-26506 and 58-163940; and bromine ions. Preferred among these compounds are compounds containing a mercapto group or disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the lightsensitive material. These bleaching accelerators are particularly effective for bleach-fixation of color lightsensitive materials for picture taking.

The bleaching solution or bleach-fixing solution preferably contains an organic acid besides the above mentioned compounds for the purpose of inhibiting bleach stain. A particularly preferred organic acid is a compound with an acid dissociation constant (pKa) of 2 to 5, more specifically, acetic acid, propionic acid and hydroxyacetic acid.

Examples of fixing agents to be contained in the fixing solution or bleach-fixing solution include thiosulfates, thiocyanates, thioether compounds, thioureas, and a large amount of iodides. The thiosulfates are normally used. In particular, ammonium thiosulfate can be most widely used. Further, thiosulfates are preferably used in combination with thiocyanates, thioether compounds, thioureas, etc. As preservatives of the fixing solution or blech-fixing solution, there can be preferably used sulfites, bisulfites, carbonyl bisulfite adducts or sulfinic acid compounds as described in European Patent 294,769A. The fixing solution or bleach-fixing solution preferably contains aminopolycarboxylic acids or organic phosphonic acids for the purpose of stabilizing the solution.

In the present invention, compounds having pKa of 6.0 to 9.0 are preferably added to the fixing solution or a bleach-fixing solution in order to pH adjustment. Preferably, imidazoles such as imidazole, 1-methylimidazole, 1-ethylimidazole, and 2-methylimidazole are added in an amount of 0.1 to 10 mol/L.

The total time required for desilvering step is preferably as short as possible so long as no maldesilvering occurs. The desilvering time is preferably in the range of 1 to 3 minutes, more preferably 1 to 2 minutes. The processing temperature is preferably in the range of 25° C. to 50° C., more preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the light-sensitive material, and a method as described in JP-A-62-183461 which comprises improving the agitating effect by a rotary means. Furthermore, specific examples of such an agitation intensifying method include a method which comprises improving the agitating effect by moving the lightsensitive material with the emulsion surface in contact with a wiper blade provided in the solution so that a turbulence occurs on the emulsion surface, and a method which comprises increasing the total circulated amount of processing solution. Such an agitation intensifying method can be effectively applied to all of the bleaching solution, bleach-fixing solution and fixing solution. The improvement in agitation effect can be considered to expedite the supply of a bleaching agent and fixing agent into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the lightsensitive material of the present invention is preferably equipped with a lightsensitive material conveying means as disclosed in JP-A's-60-191257, 60-191258 and 60-191259. As described in above JP-A-60-191257, such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

A silver halide color photographic lightsensitive material of the present invention is generally processed through washing and/or stabilizing step, after the desilvering process is performed. The amount of water used in the washing step can be set over a broad range in accordance with the characteristics of the lightsensitive materials (e.g., the kind of materials used such as couplers), the intended use of the lightsensitive material, the temperature of the water for washing, the number of washing tanks (the number of stages), a replenishing system such as a counter-current system or co-current system, and other various conditions. The relationship between the amount of water and the number of washing tanks in a multi-stage counter-current system can be obtained by a method described in "Journal of the Society of Motion Picture and Television Engineers", Vol. 64, pp. 248–253 (May, 1955).

According to the multi-stage counter-current system described in the above reference, although the amount of water for washing can be greatly reduced, bacteria would propagate due to an increase of the retention time of water in the tank, and floating masses of bacteria would stick to the lightsensitive material. In the processing for the color lightsensitive material of the present invention, in order to solve this problem, the method of reducing calcium and magnesium ions can be used very effectively, as described in JP-A-62-288838. Further, it is also effective to use a germicide such as an isothiazolone compound and thiabendazoles described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed:, "Dictionary of Antibacterial and Antifungal Agents", (1986).

The washing water has a pH value of from 4 to 9, preferably from 5 to 8 in the processing for the lightsensitive material of the present invention. The temperature of the water and the washing time can be selected from broad ranges depending on the characteristics and intended use of the lightsensitive material, but usually ranges from 15° C. to 45° C. in temperature and from 20 seconds to 10 minutes in time, preferably from 25° C. to 40° C. in temperature and from 30 seconds to 5 minutes in time. The lightsensitive material of the present invention may be directly processed with a stabilizer in place of the washing step. For the stabilization, any of the known techniques as described in JP-A's-57-8543, 58-14834 and 60-220345 can be used.

The aforementioned washing step may be followed by stabilization in some cases. For example, a stabilizing bath containing a dye stabilizer and a surfactant, which is used as a final bath for color lightsensitive materials for picture taking, can be used. Examples of such a dye stabilizer include aldehydes such as formalin and glutaraldehyde, N-methylol compounds, hexamethylenetetramine and aldehyde-sulfite adducts. This stabilizing bath may also contain various chelating agents or antifungal agents.

The overflow accompanying replenishment of the washing bath and/or stabilizing bath can be reused in other steps such as desilvering. In a processing using an automatic developing machine, if the abovementioned various processing solutions are subject to concentration due to evaporation, the concentration is preferably corrected for by the addition of water.

The silver halide color lightsensitive material of the present invention may contain a color developing agent for the purpose of simplifying and expediting processing. Such a color developing agent is preferably used in the form of various precursors, when it is contained in the lightsensitive material. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color lightsensitive material of the present invention may optionally comprise various 1-phenyl-3-pyrazolidones for the purpose of accelerating color development. Typical examples of such compounds are described in JP-A's-56-64339, 57-144547 and 58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

Further, the silver halide lightsensitive material of the present invention can be applied to heat-development lightsensitive material as described, for example, in U.S. Pat. No. 4,500,626, and JP-A's-60-133449, 59-218443 and 61-238056, and European Patent 210 660A2.

Further, the silver halide color photographic lightsensitive material of the present invention can exhibit advantages easily when it is applied to lens-fitted film unit described, for example, in Jap. Utility Model KOKOKU Publication Nos. 2-32615 and 3-39784, which is effective.

EXAMPLE

Examples of the present invention will be described below, to which, however, the present invention is in no way limited.

Example 1

(Preparation of Emulsion)

(Seed Emulsion A)

1200 mL of an aqueous solution containing 0.9 g of KBr and 3 g of common alkali processed gelatin (average molecular weight: 100 thousand), while maintaining the temperature thereof at 35° C., was agitated (preparation of the 1st solution). 37 mL of aqueous solution Ag-1 (containing 4.9 g of $AgNO_3$ per 100 mL), 37 mL of aqueous solution X-1 (containing 3.5 g of KBr per 100 mL) and 20 mL of aqueous solution G-1 (containing 2.5 g of the above gelatin per 100 mL) were added thereto at constant flow rates over a period of 30 sec by the triple jet method (Addition 1). An aqueous solution containing 5.2 g of KBr was added, and the temperature of the mixture was raised to 75° C. The mixture was ripened for 9 min, and 200 mL of aqueous solution G-2 (containing 35 g of the above gelatin per 100 mL) was added thereto.

Subsequently, 162 mL of aqueous solution Ag-2 (containing 14.9 g of $AgNO_3$ per 100 mL) and 159 mL of aqueous solution X-2 (containing 8.1 g of KBr and 0.24 g of KI per 100 mL) were added to the mixture over a period of 20 min by the double jet method while accelerating the flow rates thereof (Addition 2).

Then, aqueous solution X-3 (containing 23.0 g of KBr and 3.6 g of KI per 100 mL) and 803 mL of aqueous solution Ag-3 (containing 13.3 g of $AgNO_3$ per 100 mL) were added to the mixture over a period of 25 min by the double jet method while accelerating the flow rates thereof. During the period, the addition of aqueous solution X-3 was performed so that the silver potential of bulk emulsion solution in the reaction vessel was maintained at 0 mV (saturated calomel electrode) (Addition 3).

The resultant mixture was desalted by the customary flocculation method, and water, NaOH and gelatin were added under agitation so as to adjust the pH and pAg at 56° C. to 5.8 and 8.8, respectively, and adjust the weight in terms of silver and gelatin weight per kg of emulsion to be 103.4 g and 102 g, respectively. The thus obtained emulsion was such that 98% or more of all the grains (numerical ratio) were constituted of tabular grains of silver iodobromide having (111) faces as parallel main planes, and the average equivalent sphere diameter thereof was 0.63 $\mu$m (similar results were obtained with respect to the following seed emulsions B and C).

(Seed Emulsion B)

This seed emulsion was prepared in the same manner as in the above preparation of seed emulsion A except for the following changes.

In the preparation of the 1st solution, the amount of KBr was changed from 0.9 g to 0.3 g. The alkali processed gelatin having an average molecular weight of 100 thousand was replaced by an alkali processed gelatin having an average molecular weight of 15 thousand. The temperature was maintained at 30° C. in place of 35° C.

In the Addition 1, the gelatin having an average molecular weight of 100 thousand contained in the aqueous solution G-1 was replaced by a gelatin having an average molecular weight of 15 thousand. The addition of aqueous solution Ag-1, aqueous solution X-1 and aqueous solution G-1 by the triple jet method at constant flow rates was performed for 15 sec in place of 30 sec. The time of ripening after the temperature rise to 75° C. was changed from 9 min to 15 min.

(Seed Emulsion C)

This seed emulsion was prepared in the same manner as in the above preparation of seed emulsion B except for the following change.

In the preparation of the 1st solution, the alkali processed gelatin having an average molecular weight of 15 thousand was replaced by an oxidized gelatin (gelatin having its methionine oxidized with hydrogen peroxide, whose average molecular weight was 15 thousand).

(Emulsion 1-A)

1200 mL of an aqueous solution containing 67 g of the above seed emulsion A, 32 g of crosslinked high-molecular-weight gelatin (the molecular weight distribution measured by the PAGI method exhibited a high-molecular-weight component content of 12.4% and a low-molecular-weight component content of 48.3%) and 1.4 g of KBr, while maintaining the temperature and pH value thereof at 75° C. and 5, respectively, was agitated (preparation of the 1st solution).

Subsequently, aqueous solution X'-1 (containing 11.5 g of KBr and 1.8 g of KI per 100 mL) and 935 mL of aqueous solution Ag'-1 (containing 16 g of $AgNO_3$ per 100 mL) were added to the solution over a period of 70 min by the double jet method while accelerating the flow rates thereof. During the period, the addition of aqueous solution X'-1 was performed so that the silver potential of bulk emulsion solution in the reaction vessel was maintained at 10 mV (saturated calomel electrode) (Addition 1).

Then, an aqueous solution containing 1.8 mg of sodium benzenethiosulfonate was added, and cooled to 40° C. Further, an aqueous solution containing 0.08 mg of potassium iridium hexachloride was added. Still further, aqueous solution X'-2 (containing 10.9 g of KBr and 2.7 g of KI per 100 mL) and 275 mL of aqueous solution Ag'-2 (containing 16 g of $AgNO_3$ per 100 mL) were added to the mixture over a period of 20 min by the double jet method. During the period, the addition of aqueous solution X'-2 was performed so that the silver potential of bulk emulsion solution in the reaction vessel was maintained at 30 mV (saturated calomel electrode) (Addition 2).

Thereafter, 10 mL of phenoxyethanol was added, and an aqueous solution containing 0.4 g of KI was added over a period of 1 min. Further, the sensitizing dye of the following Chemical formula 1 (gelatin dispersion) was added in an amount corresponding to 80% of saturated adsorption quantity over the grains. Still further, an aqueous solution containing 3 mg of potassium hexacyanoruthenate was added to the mixture.

Furthermore, 55 mL of aqueous solution Ag'-3 (containing 16 g of $AgNO_3$ per 100 mL) and 87 mL of aqueous solution X'-3 (containing 6 g of NaCl and 8.1 g of KBr per 100 mL) were added to the mixture over a period of 5 min by the double jet method (Addition 3).

Then, aqueous solution X-4 (containing 11.6 g of KBr and 5.1 g of KI per 100 mL) and 41 mL of aqueous solution Ag-4 (containing 16 g of $AgNO_3$ per 100 mL) were added to the mixture over a period of 4 min (Addition 4).

Finally, 40 mg of the compound of the following Chemical formula 2 was added to the mixture.

Chemical formula 1

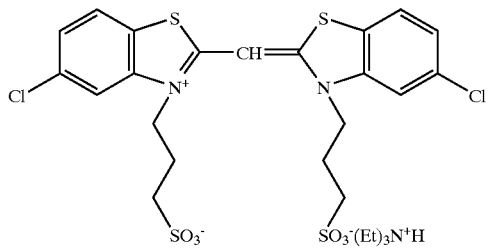

Chemical formula 2

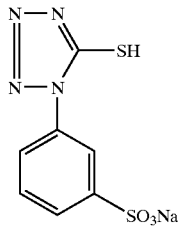

The resultant mixture was cooled to 35° C., and subjected to customary washing with water. 52 g of gelatin was added thereto and dispersed at 40° C. to thereby cause the pH value to be 6.5. The silver potential thereof was adjusted to 80 mV against saturated calomel electrode with the use of an aqueous solution of NaCl. 4 mg of the compound of the following Chemical formula 3 was added, and the optimum chemical sensitization of the mixture was attained by sequentially adding potassium thiocyanate, chloroauric acid, sodium thiosulfate and N,N-dimethylselenourea. The chemical sensitization was terminated by adding the water soluble mercapto compound of the following Chemical formula 4. The optimum chemical sensitization means that the photographic speed is maximized at 1/100 sec exposure.

Chemical formula 3

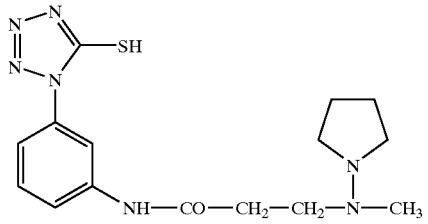

Chemical formula 4

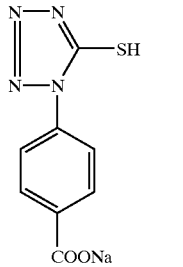

The thus obtained emulsion was such that 97% or more of all the grains (numerical ratio) were constituted of tabular grains of silver iodochlorobromide having (111) faces as parallel main planes, and the average equivalent sphere diameter thereof was 1.7 μm.

(Emulsion 1-B)

This emulsion was prepared in the same manner as in the above preparation of emulsion 1-A except for the following change.

In the Addition 3 for preparing the emulsion 1-A, an aqueous solution X"-3 (containing 8 g of NaCl and 4 g of KBr per 100 mL) was used in place of the aqueous solution X"-3 (containing 6 g of NaCl and 8.1 g of KBr per 100 mL).

(Emulsion 1-C)

This emulsion was prepared in the same manner as in the above preparation of emulsion 1-B except for the following change.

The above seed emulsion B was employed in place of the seed emulsion A.

(Emulsion 1-D)

This emulsion was prepared in the same manner as in the above preparation of emulsion 1-B except for the following change.

The above seed emulsion C was employed in place of the seed emulsion A.

(Emulsion 1-E)

This emulsion was prepared in the same manner as in the above preparation of emulsion 1-A except for the following change.

In the Addition 1 for preparing the emulsion 1-A, the addition of aqueous solution Ag'-1 and aqueous solution X'-1 by the double jet method was performed while maintaining the silver potential of bulk emulsion solution in the reaction vessel at −30 mV in place of 10 mV.

(Emulsion 1-F)

This emulsion was prepared in the same manner as in the above preparation of emulsion 1-E except for the following change.

In the Addition 3 for preparing the emulsion 1-E, an aqueous solution X"-3 (containing 8 g of NaCl and 4 g of KBr per 100 mL) was used in place of the aqueous solution X'-3 (containing 6 g of NaCl and 8.1 g of KBr per 100 mL).

(Emulsion 1-G)

This emulsion was prepared in the same manner as in the above preparation of emulsion 1-F except for the following change.

The above seed emulsion B was employed in place of the seed emulsion A.

(Emulsion 1-H)

This emulsion was prepared in the same manner as in the above preparation of emulsion 1-F except for the following change.

The above seed emulsion C was employed in place of the seed emulsion A.

(Emulsion 1-I)

This emulsion was prepared in the same manner as in the above preparation of emulsion 1-A except for the following change.

In the Addition 1 for preparing the emulsion 1-A, in place of the addition of aqueous solution Ag'-1 and aqueous solution X'-1 by the double jet method, 935 mL of aqueous solution Ag'-1 (containing 16 g of $AgNO_3$ per 100 mL) and 888 mL of aqueous solution X"-1 (containing, per 100 mL, 11.5 g of KBr and 1.8 g of KI and further 20 g of gelatin having its methionine oxidized with hydrogen peroxide, whose average molecular weight was 15 thousand) were mixed together in a chamber equipped with magnetic coupling induction type agitator as described in JP-A-10-43570, other than the main reaction vessel, thereby simultaneously preparing ultrafine grains of silver iodobromide, and continuously incorporated in the main reaction vessel. During this period, the incorporation of ultrafine grains of silver iodobromide was performed so that the silver potential of bulk emulsion solution in the reaction vessel was maintained at 0 mV (saturated calomel electrode).

(Emulsion 1-J)

This emulsion was prepared in the same manner as in the above preparation of emulsion 1-I except for the following change.

In the Addition 3 for preparing the emulsion 1-I, an aqueous solution X"-3 (containing 8 g of NaCl and 4 g of KBr per 100 mL) was used in place of the aqueous solution X'-3 (containing 6 g of NaCl and 8.1 g of KBr per 100 mL).

(Emulsion 1-K)

This emulsion was prepared in the same manner as in the above preparation of emulsion 1-J except for the following change.

The above seed emulsion B was employed in place of the seed emulsion A.

(Emulsion 1-L)

This emulsion was prepared in the same manner as in the above preparation of emulsion 1-K except for the following change.

In the Addition 3 for preparing the emulsion 1-L, an aqueous solution X"'-3 (containing 10 g of NaCl per 100 mL) was used in place of the aqueous solution X"-3 (containing 8 g of NaCl and 4 g of KBr per 100 mL).

With respect to the above emulsions 1-A to 1-M, the grain configuration data, ratio (numerical ratio) of tabular grains each having six epitaxial junction portions in apex portions of host grains to all the grains, ratio (numerical ratio) of tabular grains each having at least one dislocation line in at least one of epitaxial junction portions to all the grains, and ratio (numerical ratio) of tabular grains each having two parallel twin planes whose spacing is 0.012 or 0.008 μm or less to all the grains are summarized in the following Table 1 (all the values are those determined by the observation made through an electron microscope according to the method described herein).

TABLE 1

| Emulsion name | Average aspect ratio of all grains (host grains) | Average equivalent-circle diameter of all grains (host grains) | Average grain thickness of all grains (host grains) | Ratio of tabular grains satisfying equivalent-circle diameter ≧ 3.0 m and aspect ratio ≧ 8 |
|---|---|---|---|---|
| 1-A | 6.5 | 2.77 (μm) | 0.426 (μm) | 40(%) |
| 1-B | 6.5 | 2.77 (μm) | 0.426 (μm) | 40(%) |
| 1-C | 6.5 | 2.77 (μm) | 0.426 (μm) | 40(%) |
| 1-D | 6.5 | 2.77 (μm) | 0.426 (μm) | 40(%) |
| 1-E | 10 | 3.20 (μm) | 0.320 (μm) | 59(%) |
| 1-F | 10 | 3.20 (μm) | 0.320 (μm) | 59(%) |
| 1-G | 10 | 3.20 (μm) | 0.320 (μm) | 59(%) |
| 1-H | 10 | 3.20 (μm) | 0.320 (μm) | 59(%) |
| 1-I | 15 | 3.66 (μm) | 0.244 (μm) | 78(%) |
| 1-J | 15 | 3.66 (μm) | 0.244 (μm) | 78(%) |
| 1-K | 15 | 3.66 (μm) | 0.244 (μm) | 78(%) |
| 1-L | 15 | 3.66 (μm) | 0.244 (μm) | 78(%) |
| 1-M | 15 | 3.66 (μm) | 0.244 (μm) | 78(%) |

| Emulsion name | Ratio of tabular grains having six epitaxial portions per grain in apex portions of host grain | Ratio of tabular grains having at least one dislocation line in epitaxial portion | Ratio of tabular grains having two parallel twin plane spacing of 0.012 μm or less | Ratio of tabular grains having two parallel twin plane spacing of 0.008 μm or less |
|---|---|---|---|---|
| 1-A | 90% or more | 43(%) | 42(%) | 0 |
| 1-B | 90% or more | 61(%) | 42(%) | 0 |
| 1-C | 90% or more | 61(%) | 59(%) | 10 |
| 1-D | 90% or more | 61(%) | 100(%) | 60 |
| 1-E | 90% or more | 41(%) | 42(%) | 0 |
| 1-F | 90% or more | 60(%) | 42(%) | 0 |
| 1-G | 90% or more | 60(%) | 58(%) | 10 |
| 1-H | 90% or more | 60(%) | 100(%) | 59 |
| 1-I | 90% or more | 40(%) | 40(%) | 0 |
| 1-J | 90% or more | 60(%) | 40(%) | 0 |
| 1-K | 90% or more | 60(%) | 56(%) | 9 |
| 1-L | 90% or more | 60(%) | 97(%) | 58 |
| 1-M | 90% or more | 82(%) | 97(%) | 58 |

The above seed emulsion C was employed in place of the seed emulsion A.

(Emulsion 1-M)

This emulsion was prepared in the same manner as in the above preparation of emulsion 1-L except for the following change.

(Preparation of Coating Sample and Estimation thereof)

A support of cellulose triacetate film furnished with a substratum was coated with each of the above emulsions 1-A to 1-M under the coating conditions indicated in the following Table 2.

TABLE 2

| Emulsion Coating Conditions | |
|---|---|
| (1) Emulsion layers | |
| Emulsions | various emulsions (Silver $1.63 \times 10^{-2}$ mol/m$^2$) |
| Coupler | ($2.26 \times 10^{-3}$ mol/m$^2$) |

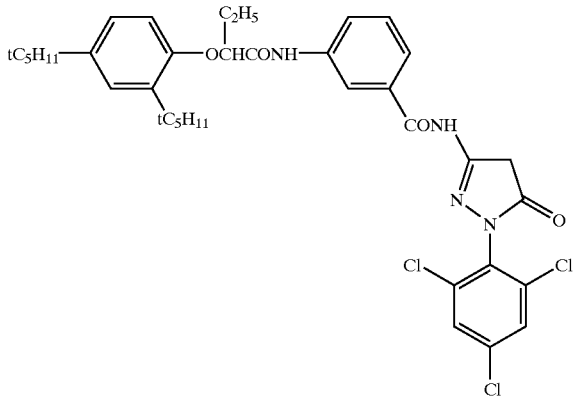

| | |
|---|---|
| Tricresyl phosphate | (1.32 g/m$^2$) |
| Gelatin | (3.24 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples 101 to 113 were subjected to a film hardening process at 40° C. and a relative humidity of 70% for 14 hr. The resultant samples were exposed for 1/100 sec through a gelatin filter SC-39 (a long wavelength light-transmitting filter having a cutoff wavelength of 390 nm) manufactured by Fuji Photo Film Co., Ltd. and a continuous wedge. The density of each sample developed as will be described later was measured through a green filter to evaluate the photographic sensitivity and gradation property.

By using the FP-350 negative processor manufactured by Fuji Photo Film Co., Ltd., the resultant samples were processed by the following steps (until the accumulated replenisher amount of each solution was three times the mother solution tank volume).

(Processing steps)

| Step | Time | Temperature | Replenishment rate* |
|---|---|---|---|
| Color development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |
| Washing (2) | 1 min. 00 sec. | 35° C. | 30 mL |

-continued (Processing steps)

| Step | Time | Temperature | Replenishment rate* |
|---|---|---|---|
| Stabilization | 40 sec. | 38° C. | 20 mL |
| Drying | 1 min. 15 sec. | 55° C. | |

*The replenishment rate is represented by a value per 1.1 m of a 35-mm wide sensitive material (equivalent to one role of 24 Ex. film).

The compositions of the processing solutions are presented below.

| (Color Developer) | Tank Solution (g) | Replenisher (g) |
|---|---|---|
| Diethylenetriamine pentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl) amino]-2-Methyl-aniline sulfate | 4.5 | 5.5 |
| Water to make | 1.0 L | 1.0 L |
| pH (adjusted by potassium hydroxide and sulfuric acid) | 10.05 | 10.10 |

(Bleaching Solution) Common to Both Tank Solution and Reprenisher (g)

| | |
|---|---|
| Ammonium ethylenediamine tetraacetato ferrate dihydrate | 120.0 |
| Disodium ethylenediamine tetraacetic acid | 10.0 |
| Ammonium bromide | 100.0 |
| Ammonium nitrate | 10.0 |
| Bleach accelerator $(CH_3)_2N—CH_2—CH_2—S—S—CH_2—CH_2—CH_2—N(CH_3)_2.2HCl$ | 0.005 mole |
| Aqueous ammonia (27%) | 15.0 mL |
| Water to make | 1.0 L |
| pH (adjusted by aqueous ammonia and nitric acid) | 6.3 |

| (Bleach-Fixing Solution) | Tank Solution (g) | Replenisher (g) |
|---|---|---|
| Ammonium ethylenediamine tetraacetato ferrate dihydrate | 50.0 | — |
| Disodium ethylenediamine tetraacetic acid | 5.0 | 2.0 |
| Sodium sulfite | 12.0 | 20.0 |
| Aqueous solution of ammonium thiosulfate (700 g/L) | 240.0 mL | 400.0 mL |
| Aqueous ammonia (27%) | 6.0 mL | — |
| Water to make | 1.0 L | 1.0 L |
| pH (adjusted by aqueous ammonia and acetic acid) | 7.2 | 7.3 |

(Washing Water) Common to Both Tank Solution and Reprenisher

Tap water was passed through a mixed-bed column filled with an H-type strongly acidic cation exchange resin (Amberlite IR-120B, produced by Rhom and Haas) and an OH-type basic anion exchange resin (Amberlite IR-400, produced by the same company) to reduce the calcium and magnesium ion concentrations each to 3 mg/L or less and then thereto 20 mg/L of sodium isocyanurate dichloride and 0.15 g/L of sodium sulfate were added. The resulting solution had a pH of from 6.5 to 7.5.

| (Stabilizer) Common to both tank solution and reprenisher (g) | |
|---|---|
| Sodium p-toluenesulfinate | 0.03 |
| Polyoxyethylene-p-monononylphenyl ether (average polymerization degree: 10) | 0.2 |
| Disodium ethylenediamine tetraacetate | 0.05 |
| 1,2,4-Triazole | 1.3 |
| 1,4-Bis(1,2,4-triazol-1-ylmethyl)-piperazine | 0.75 |
| Water to make | 1.0 L |
| pH | 8.5 |

The results of photographic speed and gradation are listed in the following Table 3. The photographic speed was expressed as the relative value of reciprocal of exposure amount required for reaching a density of fog density plus 0.1 on obtained characteristic curve (photographic speed of the sample 101 was regarded as 100). With respect to the gradation, its value was defined as the slope of a line binding two points respectively indicating densities which were 0.2 and 0.8 higher than fog density on the characteristic curve, and expressed as the relative value thereof (gradation of the sample 101 was regarded as 100).

TABLE 3

| Sample name | Emulsion name | *Sensitivity | *Gradient | Remarks |
|---|---|---|---|---|
| 101 | 1-A | 100 | 100 | Comparative example |
| 102 | 1-B | 107 | 105 | Comparative example |

TABLE 3-continued

| Sample name | Emulsion name | *Sensitivity | *Gradient | Remarks |
|---|---|---|---|---|
| 103 | 1-C | 112 | 107 | Comparative example |
| 104 | 1-D | 117 | 108 | Comparative example |
| 105 | 1-E | 112 | 106 | Comparative example |
| 106 | 1-F | 117 | 108 | Comparative example |
| 107 | 1-G | 138 | 121 | Present invention |
| 108 | 1-H | 145 | 129 | Present invention |
| 109 | 1-I | 117 | 110 | Comparative example |
| 110 | 1-J | 123 | 111 | Comparative example |
| 111 | 1-K | 148 | 132 | Present invention |
| 112 | 1-L | 155 | 139 | Present invention |
| 113 | 1-M | 162 | 145 | Present invention |

*Sensitivity and gradient are expressed in relative values assuming the sensitivity and gradient of Sample 101 as 100, respectively.

It is apparent from comparison between the results of samples 101 to 106, 109 and 110 and the results of samples 107, 108 and 111 to 113 that the samples prepared with the use of emulsions of the present invention exhibit high photographic speed and enhanced gradation (contrasty).

Example 2

Emulsions 1-D', 1-H' and 1-M' furnished with hole trapping zones were prepared in the same manner as in the preparation of the emulsions 1-D, 1-H and 1-M of Example 1, respectively, except that an aqueous solution containing 1.5 g of sodium catecholdisulfonate was added 2 min before the Addition 1 for each of the emulsions and that an aqueous solution containing 0.002 g of thiourea dioxide was added 1 min before the Addition 1 for each of the emulsions. These prepared emulsions were used in coating in the same manner as in Example 1, thereby obtaining samples 201 to 206 specified in the following Table 4. Estimation of the photographic performance thereof was also performed in the same manner as in Example 1. The results are listed in the following Table 4.

TABLE 4

| Sample name | Emulsion name | Ratio of tabular grains satisfying equivalent-circle diameter ≧3.0 μm and aspect ratio ≧8 | Presence or absence of positive hole-capturing zone | *Sensitivity | *Gradient | Remarks |
|---|---|---|---|---|---|---|
| 201 | 1-D | 40(%) | Absence | 100 | 100 | Comparative example |
| 202 | 1-D' | 40(%) | Presence | 120 | 102 | Comparative example |
| 203 | 1-H | 59(%) | Absence | 123 | 119 | Present invention |
| 204 | 1-H' | 59(%) | Presence | 158 | 137 | Present invention |
| 205 | 1-M | 78(%) | Absence | 138 | 134 | Present invention |
| 206 | 1-M' | 78(%) | Presence | 178 | 148 | Present invention |

*Sensitivity and gradient are expressed in relative values assuming the sensitivity and gradient of Sample 201 as 100, respectively.

It is apparent from comparison between the results of samples 201 and 202 and the results of samples 203 to 206 that the samples prepared with the use of emulsions of the present invention, by virtue of the incorporation of hole trapping zones, exhibit high photographic speed and enhanced gradation (contrasty).

Example 3

(Preparation of Emulsion)

(Em-A)

1192 mL of an aqueous solution containing 0.96 g of a low-molecular-weight gelatin and 0.9 g of KBr was vigorously agitated while maintaining the temperature thereof at 40° C. 37.5 mL of an aqueous solution containing 1.49 g of $AgNO_3$ and 37.5 mL of an aqueous solution containing 1.5 g of KBr were added by the double jet method over a period of 30 sec. 1.2 g of KBr was added and heated to 75° C., and the mixture was ripened. After satisfactory ripening, 30 g of gelatin trimellitate of 100,000 molecular weight obtained by chemically modifying amino groups of gelatin with trimellitic acid was added. Thus, the pH was adjusted to 7.6 mg of thiourea dioxide was added. An aqueous solution of KBr and 116 mL of an aqueous solution containing 29 g of $AgNO_3$ were added by the double jet method while increasing the flow rate so that the final flow rate was 3 times the initial flow rate. During this period, the silver potential was maintained at −20 mV against saturated calomel electrode. Further, an aqueous solution of KBr and 440.6 mL of an aqueous solution containing 110.2 g of $AgNO_3$ were added by the double jet method over a period of 30 min while increasing the flow rate so that the final flow rate was 5.1 times the initial flow rate. During this period, AgI fine grain emulsion of 0.037 $\mu$m grain size was simultaneously added while conducting a flow rate increase so that the silver iodide content became 15.8 mol %, and the silver potential was maintained at 0 mV against saturated calomel electrode. Still further, an aqueous solution of KBr and 96.5 mL of an aqueous solution containing 24.1 g of $AgNO_3$ were added by the double jet method over a period of 3 min. During this period, the silver potential was maintained at 0 mV. 26 mg of sodium ethylthiosulfonate was added, and the mixture was cooled to 55° C. An aqueous solution of KBr was added so that the silver potential was adjusted to −90 mV. The above-mentioned AgI fine grain emulsion was added in an amount of 8.5 g in terms of the weight of KI. Immediately after the completion of the addition, 228 mL of an aqueous solution containing 57 g of $AgNO_3$ was added over a period of 5 min. During this period, a regulation with an aqueous solution of KBr was effected so that the potential at the completion of addition was +20 mV. The thus obtained mixture was washed with water, and gelatin was added so as to adjust the pH and pAg at 40° C. to 5.8 and 8.7, respectively. Compounds 1 and 2 were added, and the mixture was heated to 60° C. The optimum chemical sensitization thereof was accomplished by the addition of sensitizing dyes 1 and 2, followed by the addition of potassium thiocyanate, chloroauric acid, sodium thiosulfate and N,N-dimethylselenourea. At the completion of chemical sensitization, compounds 3 and 4 were added. Herein, the optimum chemical sensitization means that the addition amount of sensitizing dye and each compound is selected within the range of $10^{-1}$ to $10^{-8}$ mol per mol of silver halides.

Compound 1

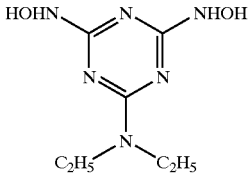

-continued

Compound 2

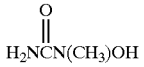

Sensitizing dye 1

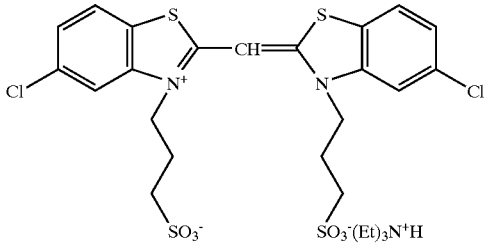

Sensitizing dye 2

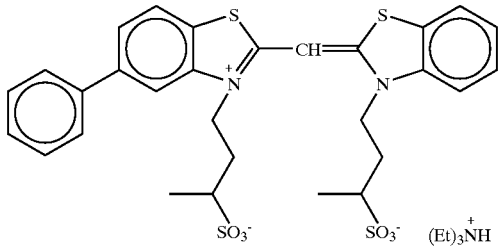

Compound 3

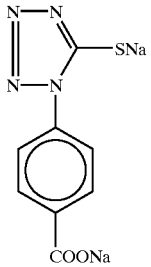

Compound 4

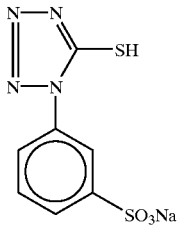

(Em-B)

1192 mL of an aqueous solution containing 1.02 g of a gelatin phthalate of 100,000 molecular weight, the gelatin phthalate containing 35 $\mu$mol of methionine per g and exhibiting a conversion to phthalate of 97%, and 0.97 g of KBr was vigorously agitated while maintaining the temperature thereof at 35° C. 42 mL of an aqueous solution containing 4.47 g of $AgNO_3$ and 42 mL of an aqueous solution containing 3.16 g of KBr were added by the double jet method over a period of 9 sec. 2.6 g of KBr was added and heated to 66° C., and the mixture was satisfactorily ripened. After the completion of ripening, 41.2 g of the same gelatin trimellitate of 100,000 molecular weight as used in the preparation of emulsion Em-A and 18.5 g of NaCl were added. The pH was adjusted to 7.2. 8 mg of dimethylaminoborane was added. An aqueous solution of KBr and 203 mL of an aqueous solution containing 26 g of $AgNO_3$ were added by the double jet method while increasing the flow rate so that the final flow rate was 3.8 times the initial flow rate. During this period, the silver potential was maintained at −30 mV against saturated calomel electrode. Further, an aqueous solution of KBr and 440.6 mL of an aqueous solution containing 110.2 g of $AgNO_3$ were added by the double jet method over a period of 24 min while increasing the flow rate so that the final flow rate was 5.1 times the initial flow rate. During this period, the same AgI fine grain emulsion as used in the preparation of emulsion Em-A was simultaneously added while conducting a flow rate increase so that the silver iodide content became 2.3 mol %, and the silver potential was maintained at −20 mV against saturated calomel electrode. 10.7 mL of a 1 N aqueous solution of potassium thiocyanate was added, and an aqueous solution of KBr and 153.5 mL of an aqueous solution containing 24.1 g of $AgNO_3$ were added by the double jet method over a period of 2 min and 30 sec. During this period, the silver potential was maintained at 10 mV. An aqueous solution of KBr was added so that the silver potential was adjusted to −70 mV. The above-mentioned AgI fine grain emulsion was added in an amount of 6.4 g in terms of the weight of KI. Immediately after the completion of the addition, 404 mL of an aqueous solution containing 57 g of $AgNO_3$ was added over a period of 45 min. During this period, a regulation with an aqueous solution of KBr was effected so that the potential at the completion of addition was −30 mV. The thus obtained mixture was washed with water and chemically sensitized in substantially the same manner as in the preparation of emulsion Em-A.

(Em-C)

This emulsion was prepared in substantially the same manner as in the preparation of emulsion Em-B, except that the addition amount of $AgNO_3$ at nucleation was doubled and that the regulation with an aqueous solution of KBr was effected so that the potential at the completion of addition of final 404 mL of an aqueous solution containing 57 g of $AgNO_3$ was +90 mV.

(Em-D)

1200 mL of an aqueous solution containing 0.71 g of a low-molecular-weight gelatin of 15,000 molecular weight, 0.92 g of KBr and 0.2 g of modified silicone oil as used in the preparation of emulsion Em-A was vigorously agitated while maintaining the temperature thereof at 39° C. and adjusting the pH value to 1.8. An aqueous solution containing 0.45 g of $AgNO_3$ and an aqueous solution of KBr containing 1.5 mol % of KI were added by the double jet method over a period of 17 sec. During this period, the excess concentration of KBr was held constant. The mixture was heated to 56° C., and ripened. After satisfactory ripening, 20 g of a gelatin phthalate of 100,000 molecular weight, the gelatin phthalate containing 35 $\mu$mol of methionine per g and exhibiting a conversion to phthalate of 97%, was added. The pH was adjusted to 5.9, and 2.9 g of KBr was added. An aqueous solution of KBr and 288 mL of an aqueous solution containing 28.8 g of $AgNO_3$ were added by the double jet method over a period of 53 min. During this period, the same AgI fine grain emulsion as used in the preparation of emulsion Em-A was simultaneously added so that the silver iodide content became 4.1 mol %, and the silver potential was maintained at −60 mV against saturated calomel electrode. 2.5 g of KBr was added, and an aqueous solution containing 87.7 g of $AgNO_3$ and an aqueous solution of KBr were added by the double jet method over a period of 63 min while increasing the flow rate so that the final flow rate was 1.2 times the initial flow rate. During this period, the above-mentioned AgI fine grain emulsion was simultaneously added while conducting a flow rate increase so that the silver iodide content became 10.5 mol %, and the silver potential was maintained at −70 mV. Further, 1 mg of thiourea dioxide was added, and an aqueous solution of KBr and 132 mL of an aqueous solution containing 41.8 g of $AgNO_3$ were added by the double jet method over a period of 25 min. The addition of the aqueous solution of KBr was regulated so that the potential at the completion of addition was +20 mV. 2 mg of sodium benzenethiosulfonate was added, and the pH value of the mixture was adjusted to 7.3. KBr was added so that the silver potential was adjusted to −70 mV. The above-mentioned AgI fine grain emulsion was added in an amount of 5.73 g in terms of the weight of KI. Immediately after the completion of the addition, 609 mL of an aqueous solution containing 66.4 g of $AgNO_3$ was added over a period of 10 min. During the first 6 min of the addition period, the silver potential was maintained at −70 mV with the use of an aqueous solution of KBr. The thus obtained mixture was washed with water, and gelatin was added so as to adjust the pH and pAg at 40° C. to 6.5 and 8.2, respectively. Compounds 1 and 2 were added, and the mixture was heated to 56° C. The above-mentioned AgI fine grain emulsion was added in an amount of 0.0004 mol per mol of silver, and further sensitizing dyes 3 and 4 were added. Potassium thiocyanate, chloroauric acid, sodium thiosulfate and N,N-dimethylselenourea were added so as to attain the optimum chemical sensitization. Upon the completion of chemical sensitization, compounds 3 and 4 were added to the mixture.

Sensitizing dye 3

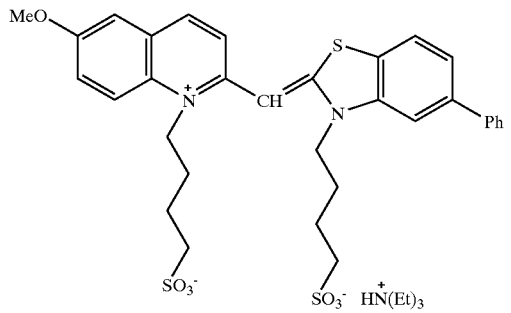

Sensitizing dye 4

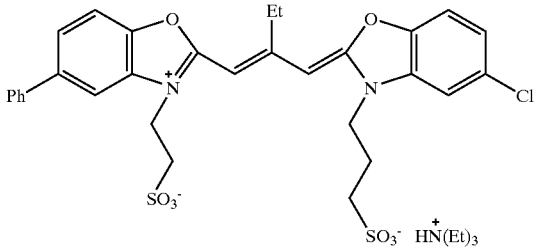

(Em-E)

This emulsion was prepared in substantially the same manner as in the preparation of emulsion Em-D, except that the addition amount of $AgNO_3$ at nucleation was changed to 3.1 times and that the sensitizing dyes used for the emulsion Em-D were changed to sensitizing dyes 5, 6 and 7.

Sensitizing dye 5

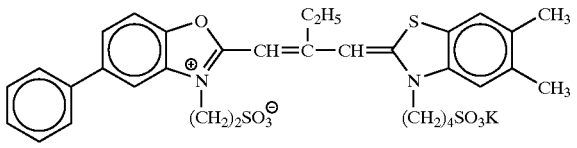

Sensitizing dye 6

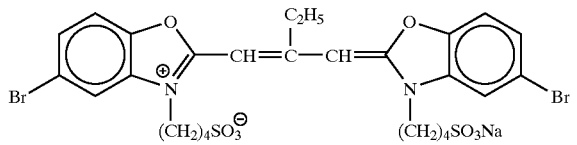

Sensitizing dye 7

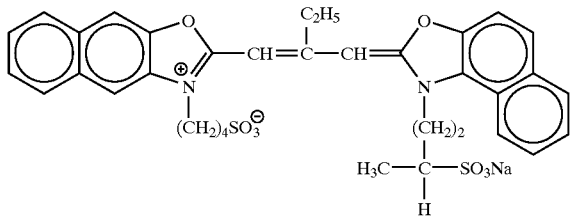

(Em-F)

1200 mL of an aqueous solution containing 0.70 g of a low-molecular-weight gelatin of 15,000 molecular weight, 0.9 g of KBr, 0.175 g of KI and 0.2 g of modified silicone oil (L7602, produced by Nippon Unicar Company, Limited) was vigorously agitated while maintaining the temperature thereof at 33° C. and adjusting the pH value to 1.8. An aqueous solution containing 1.8 g of $AgNO_3$ and an aqueous solution of KBr containing 3.2 mol % of KI were added by the double jet method over a period of 9 sec. During this period, the excess concentration of KBr was held constant. The mixture was heated to 69° C., and ripened. Upon the completion of ripening, 27.8 g of a gelatin trimellitate of 100,000 molecular weight obtained by chemically modifying amino groups of gelatin with trimellitic acid, the gelatin trimellitate containing 35 μmol of methionine per g, was added. The pH was adjusted to 6.3, and 2.9 g of KBr was added. An aqueous solution of KBr and 270 mL of an aqueous solution containing 27.58 g of $AgNO_3$ were added by the double jet method over a period of 37 min. During this period, AgI fine grain emulsion of 0.008 μm grain size (just before the addition, prepared by mixing together an aqueous solution of low-molecular-weight gelatin of 15,000 molecular weight, an aqueous solution of $AgNO_3$ and an aqueous solution of KI in a separate chamber equipped with magnetic coupling induction type agitator as described in JP-A-10-43570) was simultaneously added so that the silver iodide content became 4.1 mol %, and the silver potential was maintained at −60 mV against saturated calomel electrode. 2.6 g of KBr was added, and an aqueous solution containing 87.7 g of $AgNO_3$ and an aqueous solution of KBr were added by the double jet method over a period of 49 min while increasing the flow rate so that the final flow rate was 3.1 times the initial flow rate. During this period, the above-mentioned AgI fine grain emulsion prepared by mixing just before the addition was simultaneously added while conducting a flow rate increase so that the silver iodide content became 7.9 mol %, and the silver potential was maintained at −70 mV. Further, 1 mg of thiourea dioxide was added, and an aqueous solution of KBr and 132 mL of an aqueous solution containing 41.8 g of $AgNO_3$ were added by the double jet method over a period of 20 min. The addition of the aqueous solution of KBr was regulated so that the potential at the completion of addition was +20 mV. The mixture was heated to 78° C., and the pH value thereof was adjusted to 9.1. KBr was added so that the potential was adjusted to −60 mV. AgI fine grain emulsion as used in the preparation of emulsion Em-A was added in an amount of 5.73 g in terms of the weight of KI. Immediately after the completion of the addition, 321 mL of an aqueous solution containing 66.4 g of $AgNO_3$ was added over a period of 4 min. During the first 2 min of the addition period, the silver potential was maintained at −60 mV with the use of an aqueous solution of KBr. Washing with water and chemical sensitization were performed in substantially the same manner as in the preparation of emulsion Em-E.

(Em-G)

An aqueous solution containing 17.8 g of an ion-exchanged gelatin of 100,000 molecular weight, 6.2 g of KBr and 0.46 g of KI was vigorously agitated while maintaining the temperature thereof at 45° C. An aqueous solution containing 11.85 g of $AgNO_3$ and an aqueous solution containing 3.8 g of KBr were added by the double jet method over a period of 47 sec. The mixture was heated to 63° C., and 24.1 g of an ion-exchanged gelatin of 100,000 molecular weight was added and ripened. After satisfactory ripening, an aqueous solution containing 133.4 g of $AgNO_3$ and an aqueous solution of KBr were added by the double jet method over a period of 20 min while increasing the flow rate so that the final flow rate was 2.6 times the initial flow rate. During this period, the silver potential was maintained at +40 mV against saturated calomel electrode. 0.1 mg of $K_2IrCl_6$ was added 10 min after the start of the addition. 7 g of NaCl was added, and an aqueous solution containing 45.6 g of $AgNO_3$ and an aqueous solution of KBr were added by the double jet method over a period of 12 min. During this period, the silver potential was maintained at +90 mV. Further, 100 mL of an aqueous solution containing 29 mg of yellow prussiate of potash was added over a period of 6 min from the start of the addition. 14.4 g of KBr was added, and AgI fine grain emulsion as used in the preparation of emulsion Em-A was added in an amount of 6.3 g in terms of the weight of KI. Immediately after the completion of the addition, an aqueous solution containing 42.7 g of $AgNO_3$ and an aqueous solution of KBr were added by the double jet method over a period of 11 min. During this period, the silver potential was maintained at +90 mV. Washing with water and chemical sensitization were performed in substantially the same manner as in the preparation of emulsion Em-E.

(Em-H)

This emulsion was prepared in substantially the same manner as in the preparation of emulsion Em-G, except that the nucleation temperature was changed to 38° C.

(Em-I)

1200 mL of an aqueous solution containing 0.38 g of a gelatin phthalate of 100,000 molecular weight exhibiting a conversion to phthalate of 97% and 0.99 g of KBr was vigorously agitated while maintaining the temperature thereof at 60° C. and adjusting the pH value to 2. An aqueous solution containing 1.96 g of $AgNO_3$ and an aqueous solution containing 1.97 g of KBr and 0.172 g of KI were added by the double jet method over a period of 30 sec. The mixture was ripened, and thereafter 12.8 g of a gelatin trimellitate of 100,000 molecular weight obtained by chemically modifying amino groups of gelatin with trimellitic acid, the gelatin trimellitate containing 35 μmol of methionine per g, was added. The pH was adjusted to 5.9, and 2.99 g of KBr and 6.2 g of NaCl were added. An aqueous solution of KBr and 60.7 mL of an aqueous solution containing 27.3 g of $AgNO_3$ were added by the double jet method over a period of 35 min. During this period, the silver potential was maintained at −50 mV against saturated calomel electrode. An aqueous solution containing 65.6 g of $AgNO_3$ and an aqueous solution of KBr were added by the double jet method over a period of 37 min while increasing the flow rate so that the final flow rate was 2.1 times the initial flow rate. During this period, the same AgI fine grain emulsion as used in the preparation of emulsion Em-A was simultaneously added while conducting a flow rate increase so that the silver iodide content became 6.5 mol %, and the silver potential was maintained at −50 mV. Further, 1.5 mg of thiourea dioxide was added, and an aqueous solution of KBr and 132 mL of an aqueous solution containing 41.8 g of $AgNO_3$ were added by the double jet method over a period of 13 min. The addition of the aqueous solution of KBr was regulated so that the silver potential at the completion of addition was +40 mV. 2 mg of sodium benzenethiosulfonate was added, and thereafter KBr was added so that the silver potential was adjusted to −100 mV. The above-mentioned AgI fine grain emulsion was added in an amount of 6.2 g in terms of the weight of KI. Immediately after the completion of the addition, 300 mL of an aqueous solution containing 88.5 g of $AgNO_3$ was added over a period of 8 min. Regulation with the addition of an aqueous solution of KBr was conducted so that the potential at the completion of addition was +60 mV. The thus obtained mixture was washed with water, and gelatin was added so as to adjust the pH and pAg at 40° C. to 6.5 and 8.2, respectively. Compounds 1 and 2 were added, and the mixture was heated to 61° C. Further, sensitizing dyes 8, 9, 10 and 11 were added, and thereafter $K_2IrCl_6$, potassium thiocyanate, chloroauric acid, sodium thiosulfate and N,N-dimethylselenourea were added so as to attain the optimum chemical sensitization. Upon the completion of chemical sensitization, compounds 3 and 4 were added to the mixture.

Sensitizing dye 8

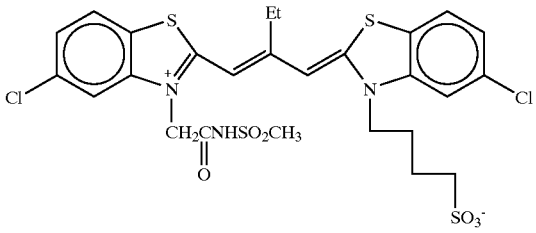

Sensitizing dye 9

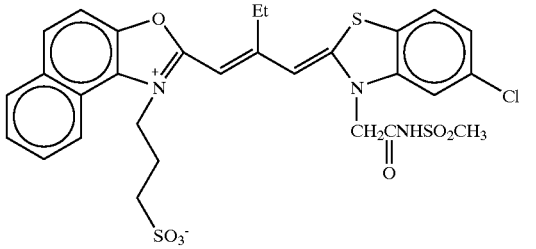

-continued

Sensitizing dye 10

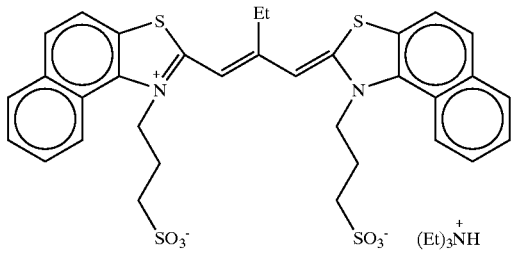

Sensitizing dye 11

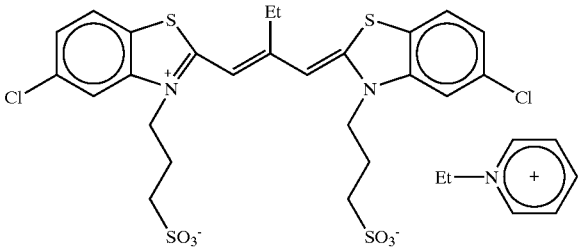

(Em-J)

1200 mL of an aqueous solution containing 4.9 g of a low-molecular-weight gelatin of 15,000 molecular weight and 5.3 g of KBr was vigorously agitated while maintaining the temperature thereof at 60° C. 27 mL of an aqueous solution containing 8.75 g of $AgNO_3$ and 36 mL of an aqueous solution containing 6.45 g of KBr were added by the double jet method over a period of 1 min. The mixture was heated to 77° C., and 21 mL of an aqueous solution containing 6.9 g of $AgNO_3$ was added over a period of 2.5 min. 26 g of $NH_4NO_3$ and 56 mL of 1 N NaOH were sequentially added to the mixture, and ripened. After the completion of ripening, the pH value of the mixture was adjusted to 4.8. 438 mL of an aqueous solution containing 141 g of $AgNO_3$ and 458 mL of an aqueous solution containing 102.6 g of KBr were added by the double jet method while increasing the flow rate so that the final flow rate was 4 times the initial flow rate. The mixture was cooled to 55° C., and an aqueous solution containing 6.46 g of KI and 240 mL of an aqueous solution containing 7.1 g of $AgNO_3$ were added by the double jet method over a period of 5 min. 7.1 g of KBr was added, and thereafter 4 mg of sodium benzenethiosulfonate and 0.05 mg of $K_2IrCl_6$ were added to the mixture. 177 mL of an aqueous solution containing 57.2 g of $AgNO_3$ and 223 mL of an aqueous solution containing 40.2 g of KBr were added by the double jet method over a period of 8 min. Washing with water and chemical sensitization were performed in substantially the same manner as in the preparation of emulsion Em-I.

(Em-K)

This emulsion was prepared in substantially the same manner as in the preparation of emulsion Em-J, except that the nucleation temperature was changed to 42° C.

(Em-L, M, N)

These emulsions, Em-L, M and N were prepared in substantially the same manner as in the preparation of emulsion Em-G or Em-H, except that the chemical sensitization was performed in substantially the same manner as in the preparation of emulsion Em-I.

(Em-O)

This emulsion was prepared in the same manner as in the preparation of emulsion Em-I, except that the sensitizing dyes were changed to sensitizing dyes 5, 6 and 7 in the performing of optimum chemical sensitization.

The characteristics of the thus obtained silver halide emulsions A to O are listed in the following Table 5.

TABLE 5

| Emulsion name | Average iodide content | Average equivalent-sphere diameter (μm) | Average diameter of projected area (μm) | Average thickness (μm) | Average aspect ratio | Ratio occupied by grains having diameter of projected area of 3 μm or more | Ratio occupied by grains having aspect ratio of 8 or more |
|---|---|---|---|---|---|---|---|
| Em-A | 10.0 | 1.0 | 2.0 | 0.16 | 12.2 | 0% | 85% |
| Em-B | 4.0 | 0.7 | 0.6 | 0.60 | 1.0 | 0% | 0% |
| Em-C | 4.1 | 0.4 | 0.5 | 0.53 | 3.5 | 0% | 0% |
| Em-D | 6.7 | 1.1 | 2.6 | 0.13 | 20.6 | 38% | 98% |
| Em-E | 6.9 | 1.2 | 2.7 | 0.15 | 18.0 | 41% | 92% |
| Em-F | 6.1 | 0.9 | 2.0 | 0.12 | 15.9 | 0% | 90% |
| Em-G | 6.0 | 0.7 | 1.2 | 0.15 | 8.0 | 0% | 53% |
| Em-H | 6.0 | 0.7 | 1.2 | 0.15 | 8.0 | 0% | 53% |
| Em-I | 3.5 | 1.3 | 3.3 | 0.14 | 24.0 | 55% | 99% |
| Em-J | 4.0 | 1.0 | 2.4 | 0.12 | 20.0 | 22% | 75% |
| Em-K | 3.6 | 0.8 | 1.9 | 0.10 | 19.0 | 0% | 94% |
| Em-L | 2.9 | 0.6 | 1.1 | 0.12 | 8.9 | 0% | 65% |
| Em-M | 2.0 | 0.4 | 0.6 | 0.11 | 6.0 | 0% | 30% |
| Em-N | 1.0 | 0.3 | 0.4 | 0.13 | 3.0 | 0% | 0% |
| Em-O | 3.7 | 1.3 | 3.2 | 0.14 | 23.0 | 52% | 99% |

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$ =6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 mg/m$^2$ of silica grains (0.3 μm) were added as a matting agent, and 15 mg/m$^2$ of aluminum oxide (0.15 μm) coated with 3-poly (polymerization degree 15) oxyethylene-propyloxytrimethoxysiliane (15 wt %) were added as a polishing agent. Drying was performed at 115° C. for 6 min (all rollers and conveyors in the drying zone were at 115°

C.). The resultant slip layer was found to have excellent characteristics; the coefficient of kinetic friction was 0.06 (5 mmø stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface on the side away from the back layers formed as above was coated with a plurality of layers having the following compositions, thereby preparing samples 301–305 which are color negative sensitive materials.

(Compositions of Sensitive Layers)

The main ingredients used in the individual layers are classified as follows.

| | |
|---|---|
| ExC: Cyan coupler | UV: Ultraviolet absorbent |
| ExM: Magenta coupler | HBS: High-boiling organic solvent |
| ExY: Yellow coupler | H: Gelatin hardener |

(In the following description, practical compounds have numbers attached to their symbols. Formulas of these compounds will be presented later.)

The number corresponding to each component indicates the coating amount in units of g/m$^2$. The coating amount of silver halide is indicated interms of silver.

(Samples 301–305)

| | | |
|---|---|---|
| **1st layer (1st antihalation layer)** | | |
| Black colloidal silver | silver | 0.155 |
| 0.07 μm of surface-fogged AgBrI(2) | silver | 0.01 |
| Gelatin | 0.87 | |
| ExC-1 | 0.002 | |
| ExC-3 | 0.002 | |
| Cpd-2 | 0.001 | |
| HBS-1 | 0.004 | |
| S-37 | 0.002 | |
| **2nd layer (2nd antihalation layer)** | | |
| Black colloidal silver | silver | 0.066 |
| Gelatin | 0.407 | |
| ExM-1 | 0.050 | |
| ExF-1 | $2.0 \times 10^{-3}$ | |
| HBS-1 | 0.074 | |
| Solid disperse dye ExF-2 | 0.015 | |
| Solid disperse dye ExF-3 | 0.020 | |
| **3rd layer (Interlayer)** | | |
| 0.07 μm of AgBrI(2) | silver | 0.020 |
| ExC-2 | 0.022 | |
| Polyethylacrylate latex | 0.085 | |
| Gelatin | 0.294 | |
| **4th layer (Low-speed red-sensitive emulsion layer)** | | |
| Silver bromoiodide emulsion Em-L | silver | 0.065 |
| Silver bromoiodide emulsion Em-M | silver | 0.258 |
| Silver bromoiodide emulsion Em-N | silver | 0.258 |
| ExC-1 | 0.109 | |
| ExC-3 | 0.044 | |
| ExC-4 | 0.072 | |
| ExC-5 | 0.011 | |
| ExC-6 | 0.003 | |
| Cpd-2 | 0.025 | |
| Cpd-4 | 0.025 | |
| HBS-1 | 0.17 | |
| Gelatin | 0.80 | |
| **5th layer (Medium-speed red-sensitive emulsion layer)** | | |
| Silver bromoiodide emulsion Em-J | silver | 0.21 |

-continued

| | | |
|---|---|---|
| Silver bromoiodide emulsion Em-K | silver | 0.62 |
| ExC-1 | 0.14 | |
| ExC-2 | 0.026 | |
| ExC-3 | 0.020 | |
| ExC-4 | 0.12 | |
| ExC-5 | 0.016 | |
| ExC-6 | 0.007 | |
| Cpd-2 | 0.036 | |
| Cpd-4 | 0.028 | |
| HBS-1 | 0.16 | |
| Gelatin | 1.18 | |
| **6th layer (High-speed red-sensitive emulsion layer)** | | |
| Silver bromoiodide emulsion Em-I | silver | 1.67 |
| ExC-1 | 0.18 | |
| ExC-3 | 0.07 | |
| ExC-6 | 0.047 | |
| Cpd-2 | 0.046 | |
| Cpd-4 | 0.077 | |
| HBS-1 | 0.37 | |
| Gelatin | 2.12 | |
| **7th layer (Interlayer)** | | |
| Cpd-1 | 0.089 | |
| Solid disperse dye ExF-4 | 0.030 | |
| HBS-1 | 0.050 | |
| Polyethylacrylate latex | 0.83 | |
| Gelatin | 0.84 | |
| **8th layer (Interlayer effect donor layer (layer for donating interlayer effect to red-sensitive layer))** | | |
| Silver bromoiodide emulsion Em-D | silver | 0.560 |
| Cpd-4 | 0.030 | |
| ExM-2 | 0.096 | |
| ExM-3 | 0.028 | |
| ExY-1 | 0.031 | |
| ExG-1 | 0.006 | |
| HBS-1 | 0.085 | |
| HBS-3 | 0.003 | |
| Gelatin | 0.58 | |
| **9th layer (Low-speed green-sensitive emulsion layer)** | | |
| Silver bromoiodide emulsion Em-F | silver | 0.39 |
| Silver bromoiodide emulsion Em-G | silver | 0.28 |
| Silver bromoiodide emulsion Em-H | silver | 0.35 |
| ExM-2 | 0.36 | |
| ExM-3 | 0.045 | |
| ExG-1 | 0.005 | |
| HBS-1 | 0.28 | |
| HBS-2 | 0.01 | |
| S-2 | 0.27 | |
| Gelatin | 1.39 | |
| **10th layer (Medium-speed green-sensitive emulsion layer)** | | |
| Silver bromoiodide emulsion Em-E | silver | 0.20 |
| Silver bromoiodide emulsion Em-F | silver | 0.25 |
| ExC-6 | 0.009 | |
| ExM-2 | 0.031 | |
| ExM-3 | 0.029 | |
| ExY-1 | 0.006 | |
| ExM-4 | 0.028 | |
| ExG-1 | 0.005 | |
| HBS-1 | 0.064 | |
| HBS-2 | $2.1 \times 10^{-3}$ | |
| Gelatin | 0.44 | |
| **11th layer (High-speed green-sensitive emulsion layer)** | | |
| Silver bromoiodide emulsion Em-O | silver | 1.200 |
| ExC-6 | 0.004 | |
| ExN-1 | 0.016 | |
| ExM-3 | 0.036 | |
| ExM-4 | 0.020 | |
| ExM-5 | 0.004 | |
| ExY-5 | 0.008 | |
| ExM-2 | 0.013 | |
| Cpd-4 | 0.007 | |
| HBS-1 | 0.18 | |
| Polyethylacrylate latex | 0.099 | |
| Gelatin | 1.11 | |

-continued

| | | |
|---|---|---|
| 12th layer (Yellow filter layer) | | |
| Yellow colloidal silver | silver | 0.047 |
| Cpd-1 | 0.16 | |
| Solid disperse dye ExF-5 | 0.010 | |
| Solid disperse dye ExF-6 | 0.010 | |
| HBS-1 | 0.082 | |
| Gelatin | 1.057 | |
| 13th layer (Low-speed blue-sensitive emulsion layer) | | |
| Silver bromoiodide emulsion Em-A | silver | 0.18 |
| Silver bromoiodide emulsion Em-B | silver | 0.20 |
| Silver bromoiodide emulsion Em-C | silver | 0.07 |
| ExC-1 | 0.041 | |
| ExC-8 | 0.012 | |
| ExY-1 | 0.035 | |
| ExY-2 | 0.71 | |
| ExY-3 | 0.10 | |
| ExY-4 | 0.005 | |
| Cpd-2 | 0.10 | |
| Cpd-3 | $4.0 \times 10^{-3}$ | |
| HBS-1 | 0.24 | |
| Gelatin | 1.41 | |
| 14th layer (High-speed blue-sensitive emulsion layer) Any one of emulsion selected from emulsions 1-A, 1-E, 1-H, 1-I, and 1-M of Example 1 | | |
| | silver | 0.75 |
| ExC-1 | 0.013 | |
| ExY-2 | 0.31 | |
| ExY-3 | 0.05 | |
| ExY-6 | 0.062 | |
| Cpd-2 | 0.075 | |
| Cpd-3 | $1.0 \times 13^{-3}$ | |
| HBS-1 | 0.10 | |
| Gelatin | 0.91 | |
| 15th layer (1st protective layer) | | |
| 0.07 μm of AgBrI (2) | silver | 0.30 |
| UV-1 | 0.21 | |
| UV-2 | 0.13 | |
| UV-3 | 0.20 | |
| UV-4 | 0.025 | |
| F-11 | 0.009 | |
| F-18 | 0.005 | |
| F-19 | 0.005 | |
| HBS-1 | 0.12 | |
| S-2 | $5.0 \times 10^{-2}$ | |
| Gelatin | 2.3 | |
| 16th layer (2nd protective layer) | | |
| H-1 | 0.40 | |
| B-1 (diameter 1.7 μm) | $5.0 \times 10^{-2}$ | |
| B-2 (diameter 1.7 μm) | 0.15 | |
| B-3 | 0.05 | |
| S-1 | 0.20 | |
| Gelatin | 0.75 | |

In addition to the above components, to improve the storagebility, processability, resistance to pressure, antiseptic properties and mildewproofing properties, the individual layers contained B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively. Furthermore, the individual layers contained at least one of W-1, W-6, W-7 and W-8 for the purpose of improving the antistatic properties, and at least one of W-2 and W-5 for the purpose of improving the coating properties. Preparation of dispersions of organic solid disperse dyes ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye FxF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.44 μm.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was found to be 0.06 μm.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

The compounds used in the above layers are those as set forth below.

ExC-1

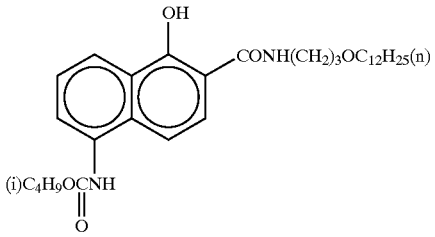

ExC-2

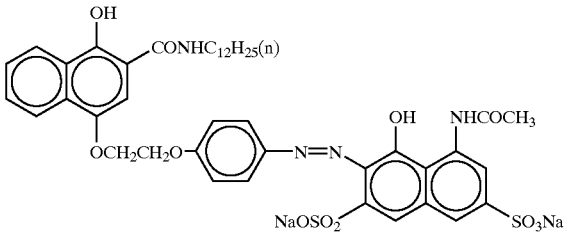

-continued
ExC-3
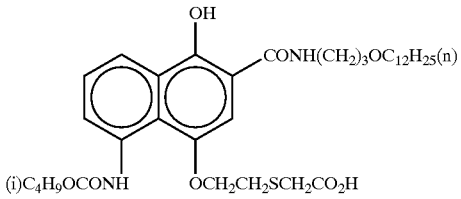
ExC-4
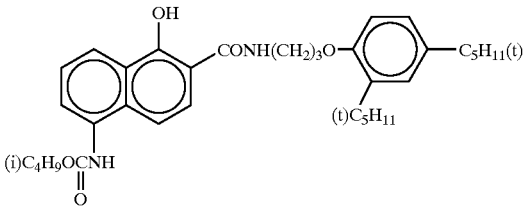
ExC-5
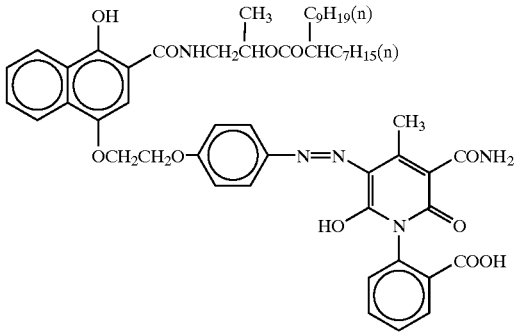
ExC-6
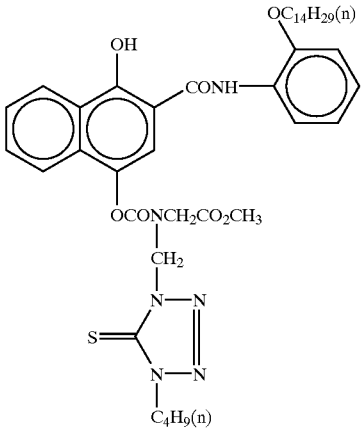
ExC-8
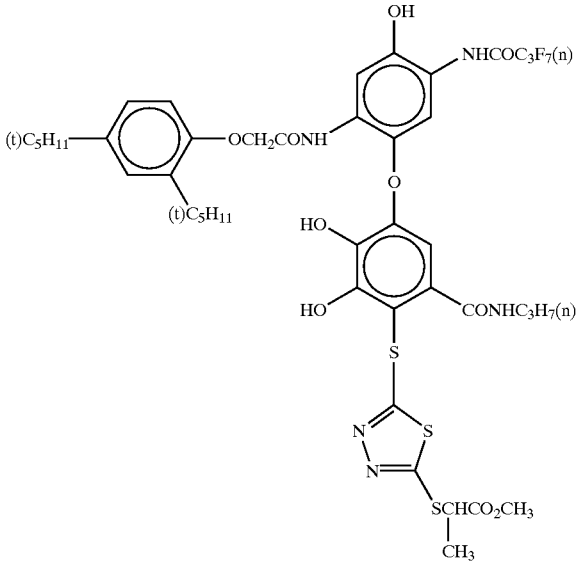

-continued
ExM-1
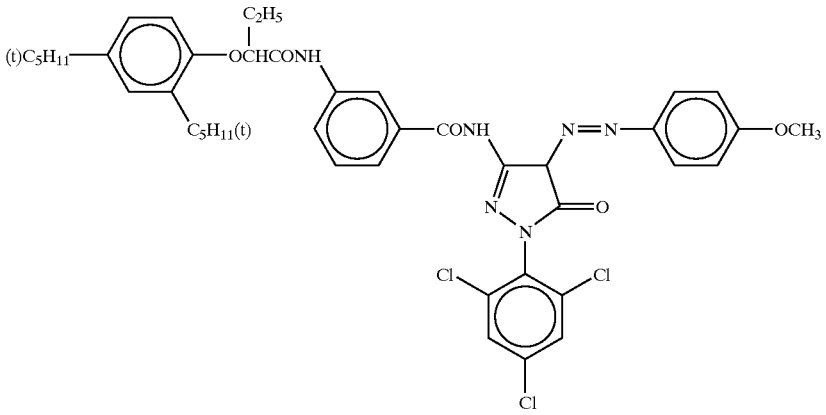
ExM-2
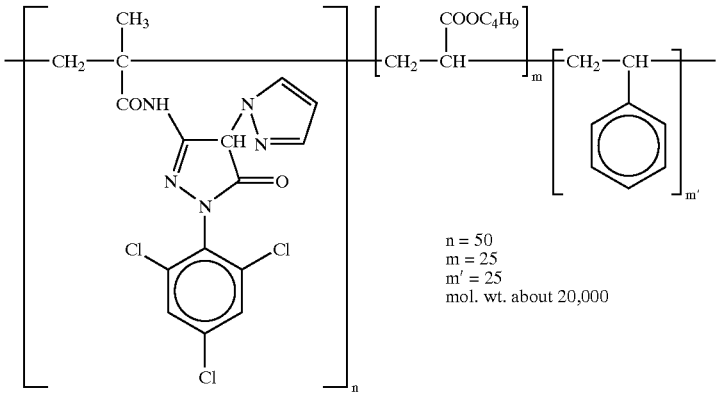
n = 50
m = 25
m′ = 25
mol. wt. about 20,000
ExM-3
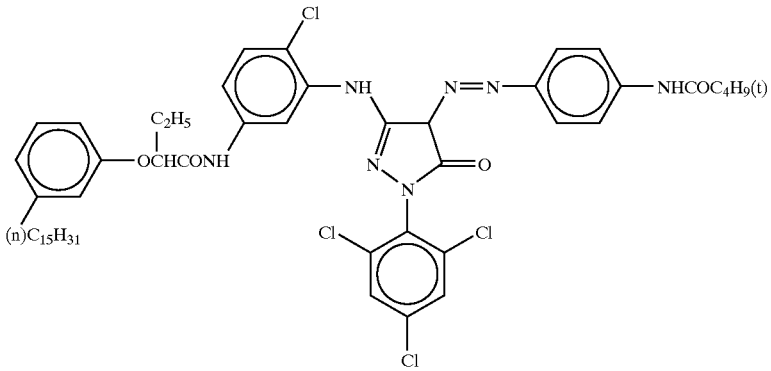
ExM-4
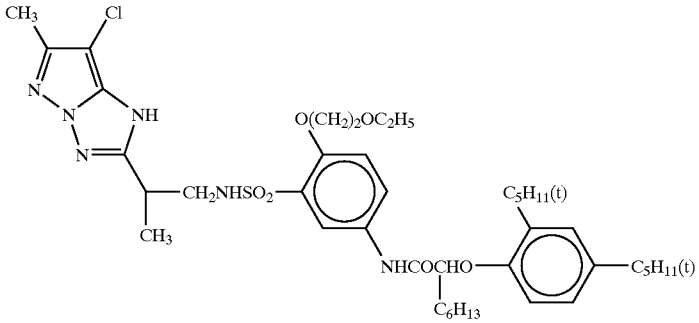

-continued
ExM-5
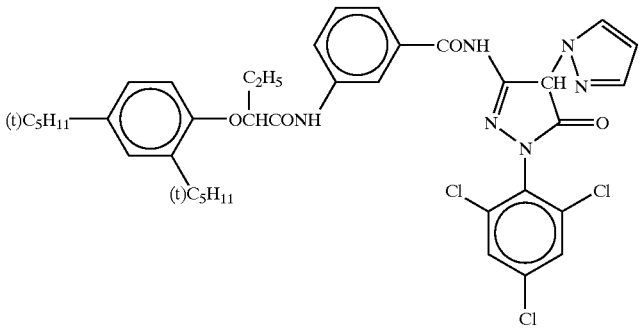
ExY-1
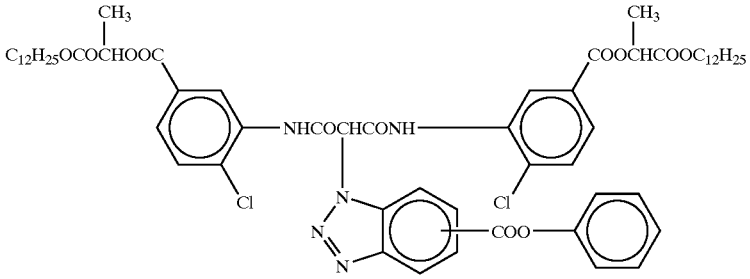
ExY-2
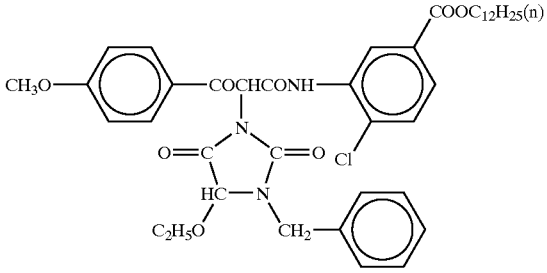
ExY-3
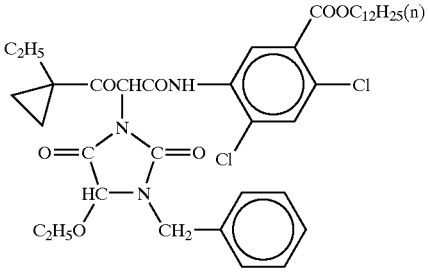
ExY-4
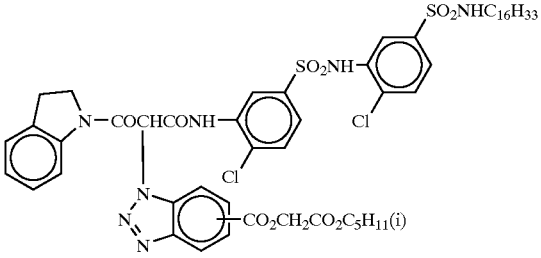
ExY-5
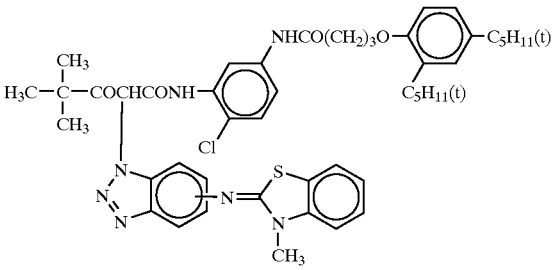
EcG-1
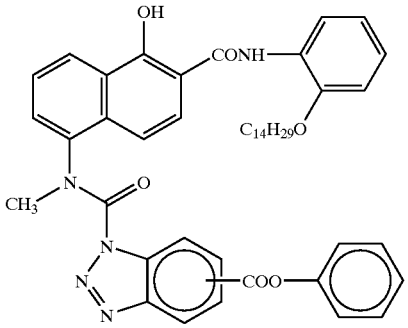
ExY-6
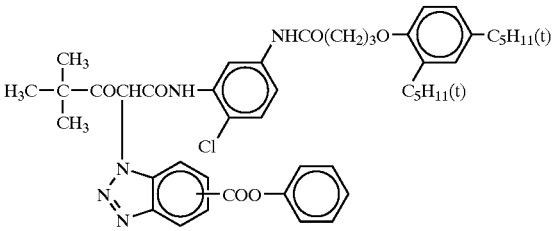

-continued
ExF-1
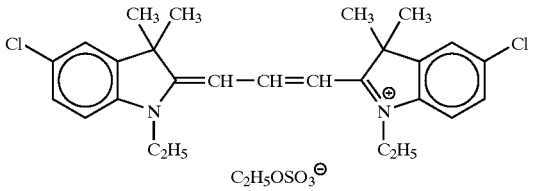
ExF-2
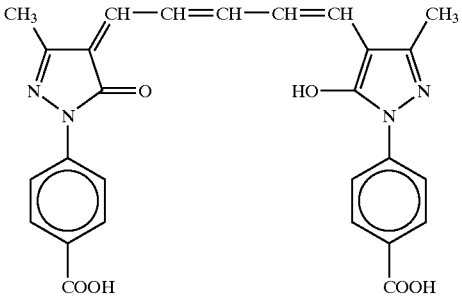
ExF-3
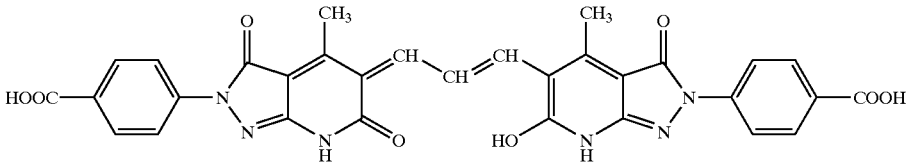
ExF-4
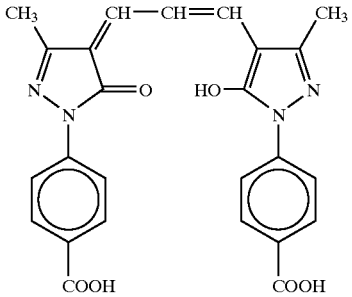
ExF-5
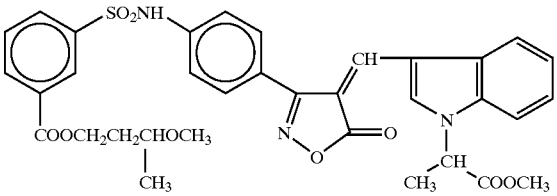
ExF-6
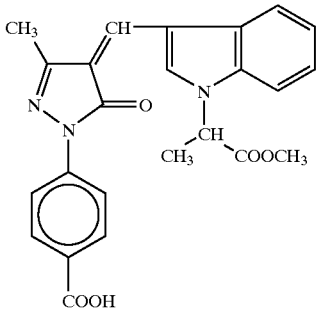
Cpd-1
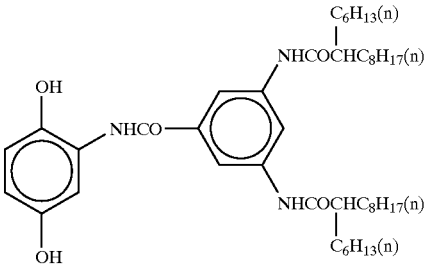
Cpd-2
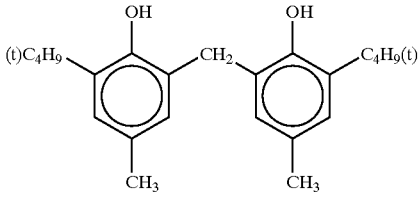
Cpd-3
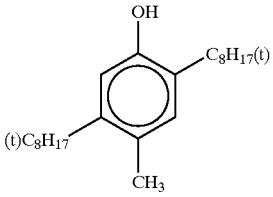
Cpd-4
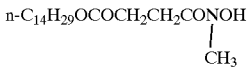
UV-1
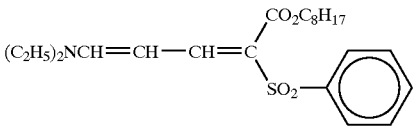

-continued
UV-2
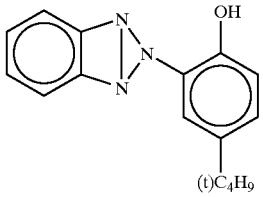
UV-3
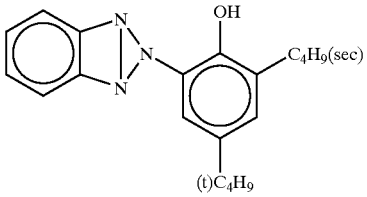
UV-4
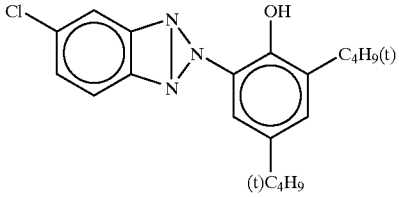
HBS-1
Tricresyl phosphate
HBS-2
Di-n-butyl phthalate
HBS-3
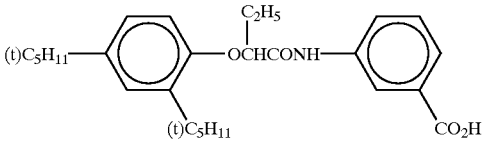
H-1
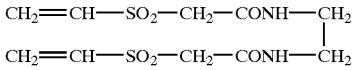
S-1
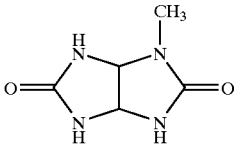
B-1
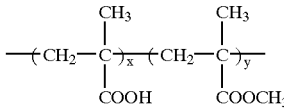
x/y = 10/90 (mass ratio)
Average molecular weight
: about 35,000
B-2
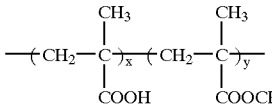
x/y = 40/60 (mass ratio)
Average molecular weight
: about 20,000
B-3
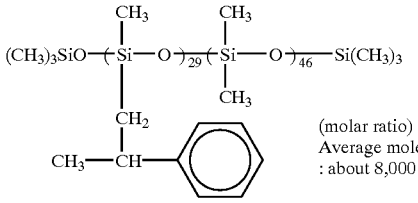
(molar ratio)
Average molecular weight
: about 8,000
B-4
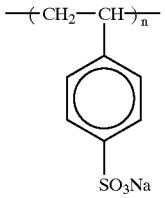
Average molecular weight
: about 750,000
B-5
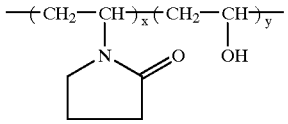
x/y = 70/30 (mass ratio)
Average molecular weight
: about 17,000
B-6
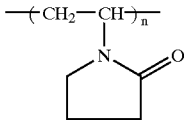
Average molecular weight
: about 10,000
W-1
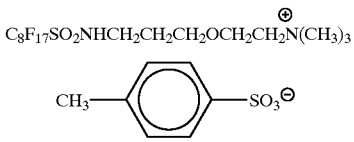
W-2
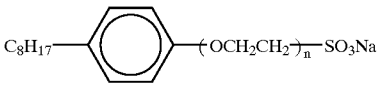
n = 2–4
W-5
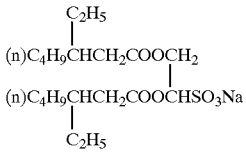
W-6
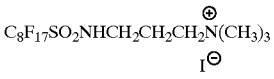

-continued
W-7
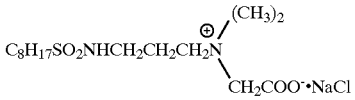
W-8
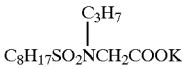
F-1
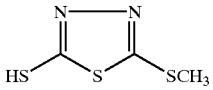
F-2
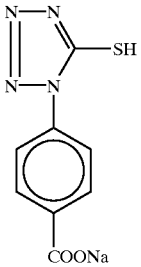
F-3
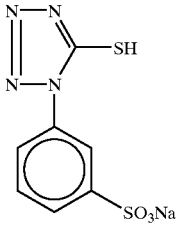
F-4
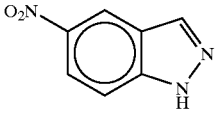
F-5
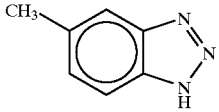
F-6
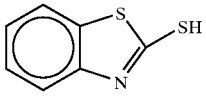
F-7
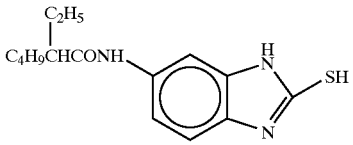
F-8
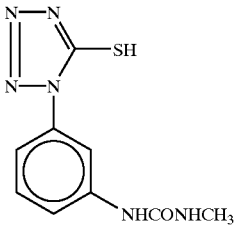
F-9
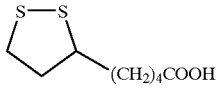
F-10
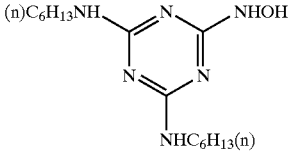
F-11
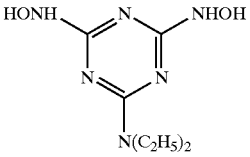
F-12
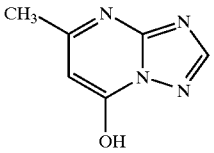
F-13
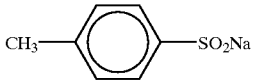
F-14
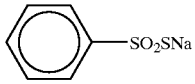

-continued

F-15

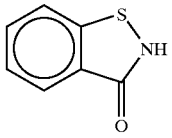

F-16

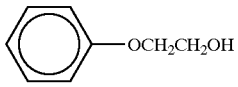

F-17

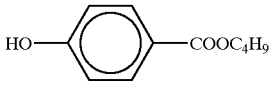

F-18

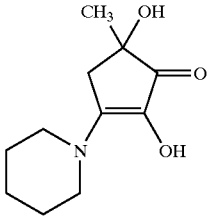

F-19

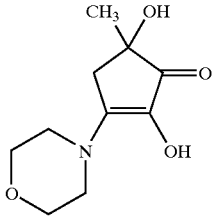

S-2

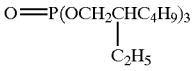

S-37

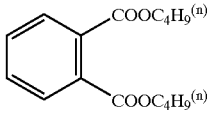

The samples were evaluated as described below. The samples were exposed for 1/100 sec through a gelatin filter SC-39 (a long wavelength light-transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |

-continued (Processing steps)

| Step | Time | Temperature | Replenishment rate* | Tank volume |
|---|---|---|---|---|
| Stabilization (2) | 20 sec | 38.0° C. | 15 mL | 3 L |
| Drying | 1 min 30 sec | 60° C. | | |

*The replenishment rate is represented by a value per 1.1 m of a 35-mm wide sensitive material (equivalent to one role of 24 Ex. film).

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each cross-over time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | <Tank solution> (g) | <Replenisher> (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixer (1) Tank solution) | | |
| A 5:95 mixture (v/v) of the above bleaching tank solution and the below fixing tank solution pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The samples 301 to 305 were subjected to the above processing. The photographic performance thereof were estimated by measuring the density of the processed samples through a blue filter. The results of photographic speed and gradation are listed in the following Table 6. The photographic speed was expressed as the relative value of reciprocal of exposure amount required for reaching a density of fog density plus 0.05 on obtained characteristic curve (photographic speed of the sample 301 was regarded as 100). With respect to the gradation, its value was defined as the slope of a line binding two points respectively indicating densities which were 0.1 and 0.3 higher than fog density on the characteristic curve, and expressed as the relative value thereof (gradation of the sample 301 was regarded as 100).

TABLE 6

| Sample name | Emulsion name | *Relative sensitivity | *Gradient | Remarks |
|---|---|---|---|---|
| 301 | 1-A | 100 | 100 | Comparative example |
| 302 | 1-E | 110 | 106 | Comparative example |
| 303 | 1-H | 141 | 127 | Present invention |
| 304 | 1-I | 115 | 108 | Comparative example |
| 305 | 1-M | 155 | 145 | Present invention |

*Sensitivity and gradient are expressed in relative values assuming the sensitivity and gradient of Sample 301 as 100, respectively.

It is apparent from comparison between the results of samples 301, 302 and 304 and the results of samples 303 and 305 that the samples prepared with the use of emulsions of the present invention exhibit high photographic speed and enhanced gradation (contrasty).

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion comprising grains, wherein 50% or more (numerical ratio) of all the grains are occupied by tabular grains with epitaxial junction meeting the requirements (i) to (v):

(i) silver iodochlorobromide grains having (111) faces as main planes and having two parallel twin planes;

(ii) an equivalent circle diameter of 3.0 μm or more and an aspect ratio of 8 or more;

(iii) each of host tabular grains has six silver halide epitaxial junction portions selectively in apex portions thereof;

(iv) at least one of the silver halide epitaxial junction portions has at least one dislocation line; and (v) a spacing between the two parallel twin planes of 0.012 μm or less.

2. The silver halide photographic emulsion according to claim 1, wherein the tabular grains with epitaxial junction further meet the following requirement:

(vi) the spacing between the two parallel twin planes of 0.008 μm or less.

3. The silver halide photographic emulsion according to claim 1, wherein 70% or more (numerical ratio) of all the grains are occupied by the tabular grains with epitaxial junction meeting the requirements (i) to (v) according to claim 1.

4. The silver halide photographic emulsion according to claim 3, wherein the tabular grains with epitaxial junction further meet the following requirement:

(vi) the spacing between the two parallel twin planes of 0.008 μm or less.

5. The silver halide photographic emulsion according to claim 1, wherein the tabular grains with epitaxial junction have a hole trapping zone inside the tabular grains.

6. The silver halide photographic emulsion according to claim 2, wherein the tabular grains with epitaxial junction have a hole trapping zone inside the tabular grains.

7. The silver halide photographic emulsion according to claim 3, wherein the tabular grains with epitaxial junction have a hole trapping zone inside the tabular grains.

8. The silver halide photographic emulsion according to claim 4, wherein the tabular grains with epitaxial junction have a hole trapping zone inside the tabular grains.

9. A silver halide photographic lightsensitive material comprising at least one layer containing a silver halide emulsion on a support, wherein at least one layer among the at least one layer contains the silver halide photographic emulsion according to claim 1.

10. A silver halide photographic lightsensitive material comprising at least one layer containing a silver halide emulsion on a support, wherein at least one layer among the at least one layer contains the silver halide photographic emulsion according to claim 2.

11. A silver halide photographic lightsensitive material comprising at least one layer containing a silver halide emulsion on a support, wherein at least one layer among the at least one layer contains the silver halide photographic emulsion according to claim 3.

12. A silver halide photographic lightsensitive material comprising at least one layer containing a silver halide emulsion on a support, wherein at least one layer among the at least one layer contains the silver halide photographic emulsion according to claim 4.

13. A silver halide photographic lightsensitive material comprising at least one layer containing a silver halide emulsion on a support, wherein at least one layer among the at least one layer contains the silver halide photographic emulsion according to claim 5.

14. A silver halide photographic lightsensitive material comprising at least one layer containing a silver halide emulsion on a support, wherein at least one layer among the at least one layer contains the silver halide photographic emulsion according to claim 6.

15. A silver halide photographic lightsensitive material comprising at least one layer containing a silver halide emulsion on a support, wherein at least one layer among the at least one layer contains the silver halide photographic emulsion according to claim 7.

16. A silver halide photographic lightsensitive material comprising at least one layer containing a silver halide emulsion on a support, wherein at least one layer among the at least one layer contains the silver halide photographic emulsion according to claim 8.

* * * * *